US005605336A

United States Patent [19]

Gaoiran et al.

[11] Patent Number: 5,605,336

[45] Date of Patent: Feb. 25, 1997

[54] DEVICES AND METHODS FOR EVALUATING ATHLETIC PERFORMANCE

[76] Inventors: Albert A. Gaoiran; Mayrose A. Gaoiran, both of 811 Cape Kennedy Dr., San Jose, Calif. 95133

[21] Appl. No.: 471,421

[22] Filed: Jun. 6, 1995

[51] Int. Cl.[6] ..... A63B 69/00

[52] U.S. Cl. ..... 273/445; 273/454; 434/247

[58] Field of Search ..... 273/26 C, 29 A, 273/187.2, 371, 440, 445, 454, 455; 434/247, 256, 258

[56] References Cited

U.S. PATENT DOCUMENTS

| | | | |
|---|---|---|---|
| 1,170,467 | 2/1916 | Taylor . | |
| 3,933,354 | 1/1976 | Goldfarb et al. | 273/1 E |
| 4,353,545 | 10/1982 | Anderson | 272/76 |
| 4,384,269 | 5/1983 | Carlson | 340/67 |
| 4,401,303 | 8/1983 | Anderson et al. | 272/76 |
| 4,461,475 | 7/1984 | Nakamura | 273/1 GC |
| 4,534,557 | 8/1985 | Bigelow et al. | 273/55 A |
| 4,536,629 | 8/1985 | Diller | 200/61.48 R |
| 4,581,505 | 4/1986 | Bal et al. | 200/61.48 R |
| 4,581,506 | 4/1986 | Bal et al. | 200/61.48 R |
| 4,627,620 | 12/1986 | Yang | 273/1 GC |
| 4,763,284 | 8/1988 | Carlin | 364/550 |
| 4,818,234 | 4/1989 | Redington et al. | 434/247 |
| 4,883,271 | 11/1989 | French | 273/1 GC |
| 4,941,660 | 7/1990 | Winn et al. | 272/76 |
| 4,955,602 | 9/1990 | Rastelli | 272/76 |
| 4,974,833 | 12/1990 | Hartman et al. | 272/76 |
| 5,134,255 | 7/1992 | Tetrault et al. | 200/61.45 R |
| 5,194,706 | 3/1993 | Reneau | 200/61.45 R |
| 5,194,707 | 3/1993 | Wallach | 200/61.45 R |
| 5,359,162 | 10/1994 | Bitko | 200/226 |

OTHER PUBLICATIONS

AMP Incorporated, (Valley Forge, PA) Catalog 65750—Preliminary—Accelerometer ACH–04–08, pp. 1–15 (1994 Rev. E).

AMP Incorporated, (Valley Forge, PA), Programming Kit for ACH–04–08 Accelerometer APK–01 —Preliminary—, pp. 1–2 (1994, Oct. 26, 1994 Rev. X1).

AMP Incorporated, (Valley Forge, PA) AMP Flexible Film Sensors, Technical Bulletin (1994, PRS Oct. 26, 1994).

Signal System International, Inc., (Lavallette, NJ), Tilt Switches, Thomas Register (1994);.

Fifth Dimension, (Trenton, NJ), Tilt Switches, Data Sheet Part No. 21638 (1993).

Aerodyne Controls, (Ronkonkoma, NY), Motion Switches (not dated).

*Primary Examiner*—Raleigh W. Chiu
*Assistant Examiner*—James Schaaf
*Attorney, Agent, or Firm*—Law Office of Albert J. Dalhuisen

[57] ABSTRACT

The present invention provides for electrical devices and methods for evaluating athletic performance. A shock sensor is attached to an athlete or a suitable target such as a punching bag. When the athlete subjects the shock sensor to a shock with a magnitude which equals or exceeds the shock sensor sensitivity, an electrical effect is generated which is processed by a control means. The control means can be programmed for a delay period which precedes the performance evaluating cycle. The athlete's reaction time and shock magnitude can be measured and displayed. The devices and methods are suitable for evaluating athletic performance even if the athlete does not contact a target or an another object such as in simulated martial arts combat wherein there is no body contact between the athletes.

52 Claims, 29 Drawing Sheets

DEVICES AND METHODS FOR EVALUATING ATHLETIC PERFORMANCE

FIELD OF THE INVENTION

The present invention relates to devices and methods for evaluating athletic performance. More particularly, the present invention relates to devices and methods for evaluating athletic performance utilizing sensors which measure shock, impact, kinetic energy or motion.

BACKGROUND OF THE INVENTION

Many sports are based on the development of athletic abilities such as specialized skills, fast responses, speed, excellent coordination and enhanced muscular strength. Athletes commonly strive to reach their potential in their sport but there are many sports wherein it is difficult to quantify or objectively measure an athlete's ability with regards to certain aspects of a specific sport. As a result of this difficulty, an athlete's performance in sports, such as, for example, karate, tennis or soccer is usually determined through a coach's observation or by competing against other athletes. Objective measurement of athletic ability is particularly beneficial for training since this provides the athlete with a means to identify those abilities and skills which require special attention and to measure improved performance. The use of a device which objectively measures an athlete's performance or skill can greatly assist athletes in reaching their potential and in deriving pleasure and satisfaction from participation in their chosen sport.

Karate is a martial arts sport which simulates certain types of unarmed combat. A karate athlete kicks or strikes with hands, arms, feet or legs while moving the whole body. The athlete may aim kicks or strikes at a target such as a punching bag or an opponent. Many karate training exercises and competitive contests involve movements designed to hit an imaginary opponent, i.e. the athlete executes hitting and striking movements without actually hitting a target. Some of the karate movements and techniques are executed in a prearranged sequence or pattern commonly referred to as a form.

Various devices have been developed for measuring skills and performance for martial arts and other combat related sports such as boxing. Typically, these devices measure the athlete's response time or the force exerted when hitting a target. See, for example U.S. Pat. No. 4,974,833 (Hartman et al. 1990) which discloses an electronic martial arts training device having illuminated target areas. The target sensor consists of a load speaker cone. Hartman et al. teach that hitting the load speaker cone induces an electric signal which is proportional to the force with which the target is struck. The '833 apparatus utilizes timed sequences to test the athlete's response time. U.S. Pat. No. 4,941,660 (Winn et al., 1990) discloses a computer interfaced device to determine the force with which a punching bag is hit by an athlete. The '660 punching bag comprises a water filled bladder having a pressure transducer. The transducer is coupled to a pressure indicator which is interfaced with a computer. Winn et al. teach that the apparatus disclosed in '660 enables the athlete to measure the force which is applied by striking or kicking the bag and the time which is elapsed between punches.

U.S. Pat. No. 4,883,271 (French, 1989) discloses sport impact measuring apparatus comprising a deformable container having a piezoelectric transducer strip attached to the outside surface. Hitting the container causes the container surface to be deformed resulting in a dimensional change in the piezoelectric strip. French teaches that the deformation of the piezoelectric strip causes the strip to generate an electrical potential which is proportional to the force which is applied by hitting the container. The '271 patent also contemplates the use of a strain gauge on a flexible container as an alternate embodiment. U.S. Pat. No. 4,818,234 (Redington et al., 1989) discloses a psychophysiological reflex arc training simulator having a target area which includes a sensor comprising a pressure transducer, such as, for example, a strain gauge. Redington et al. teach that the sensor creates a measurable electrical change which is proportional to the impact force of a hit upon the target rendering the device capable of measuring the athlete's response time between the activation prompt of the test cycle and hitting the target sensor.

U.S. Pat. No. 4,763,284 (Carlin, 1988) discloses a reaction time and force feedback system using a force sensor incorporated in a housing attached to one of the athlete's limbs or attached to a pad worn by an athlete. The sensor consisting of a strain gauge is preferably oriented on the limb in close proximity to an internal bone structure in order to maximize the detection of the forces. Carlin teaches that the apparatus is capable of measuring force magnitude and elapsed time between hits. U.S. Pat. No. 4,627,620 (Yang, 1986) discloses an electronic athlete trainer for improving skills in reflex, speed and accuracy wherein the apparatus can select targets in a random sequence and-determine the elapsed time for hitting the selected targets. The target comprises a reset switch wherein a normally closed contact is opened as a result of a hit. U.S. Pat. No. 4,534,557 (Bigelow et al., 1985) discloses a reaction time and applied force feedback sports training system wherein a strain gauge sensor is used to sense the force which is applied to a target by, for example, by hitting the target. The strain gauge comprises compression sensors and tension sensors. The athlete's reaction time is measured. Bigelow et al. teach that the device can be used by several athletes simultaneously, each hitting selected targets.

The above referenced U.S. patents attempt to measure the force with which a martial arts target or related target is hit by a user, such as an athlete, and/or the athlete's response time in hitting the target. Sensors utilized in these devices include load speaker cones, pressure transducers, compression sensors, tension sensors and strain gauges. A common shortcoming of these types of sensors is the inability to measure movement resulting from the absorption of kinetic energy which results from a hitting or kicking movement. None of the above prior art sensors is believed operable for measuring an athlete's kicking or punching movements when the athlete purposely executes a movement without hitting a target, or purposely hitting the target very lightly in order to avoid injury or discomfort.

Accordingly, the need exists for a device and method to objectively determine performance in martial arts, boxing and other simulated combat sports wherein the user, such as an athlete, does not contact a target or contacts a target very lightly.

In ball sports, such as, for example, soccer the athlete contacts the ball with the foot, leg or head in order to move the ball in a certain direction while controlling ball speed and spin. In football, the ball is kicked for example when punting or when attempting to score a field goal.

Bigelow et al. '557 teach that a conventional football can be adapted to contain a pressure transducer to sense the applied force when the ball is kicked. It is well known to those skilled in the art that the playing characteristics of a ball used in, for example, soccer or football are greatly affected by the attachment of an external device thus making the '557 device undesirable for evaluating the athlete's performance.

Carlin '284 teaches a strain gauge sensor attached to a limb for measuring force exerted by that limb. It is well known to those skilled in the art that kicking a ball involves transmitting the foot's kinetic energy to the ball. Carlin stresses the importance of placing the sensor in close proximity to the shin bone. However, it is thought that the complex movements which are involved in kicking a ball involve flexing the ankle as the kick is executed. Consequently, strain gauge measurements of the force exerted by the leg or foot bones are undesirable for measuring ball kicking performance.

Accordingly, the need exists for a device and method for determining ball kicking performance by measuring the kinetic impact exerted by the foot on the ball in a manner which takes into account the flexing of the ankle during kicking.

In tennis, the player attempts to hit a ball with a racket over a net into the opponent's court. This sport requires power and accuracy in hitting the ball. Players use different techniques to hit the ball in order to achieve a desired special effect, such as, for example, giving the ball a spin motion as well as a forward motion. Similarly, power and accuracy are needed in baseball where a ball is hit with a bat. In sports such as tennis and baseball, the athlete's contact with the ball is indirect since the ball is moved by a racket or a bat rather than by direct contact with the athlete.

U.S. Pat. No. 1,170,467 (Taylor, 1916) discloses a baseball training apparatus using a ball equipped with a sensor for sensing air compression when the ball is struck with a bat. The Taylor device is undesirable for measuring baseball hitting performance since the sensor ball is not a typical baseball because it is mounted on a plunger. Also the device is thought to be poorly suited for testing under playing conditions since the sensor makes the ball unsuitable for the ball pitching techniques which are typical of baseball.

Accordingly, the need exists for a device and method which enables the user, such as an athlete, to determine ball hitting performance in sports such as baseball and tennis wherein the athlete hits a ball by means of a racket, bat or stick such as a hockey stick.

SUMMARY OF THE INVENTION

The present invention provides novel devices and methods for evaluating athletic performance.

In one embodiment the present invention provides a method and a device including a shock sensor and a control means to measure a user's response time or reaction time and shock magnitude when hitting a target.

In another embodiment the present invention provides a method and a device including a shock sensor and a control means to measure a user's response time and shock magnitude when simulating hitting a target.

In yet another embodiment the present invention provides a method and a device including a shock sensor, a control means, a sound module, a tone generator and a microphone to provide audible indicators when measuring a user's response time and shock magnitude when hitting a target or when simulating hitting a target.

In still another embodiment the present invention provides a method and a device including one or two shock sensors, a control means and shock magnitude display unit to measure the response time and shock magnitude where one or two users hit a target or simulate hitting a target.

In another embodiment the present invention provides a method and a device including one or two shock sensors, a control means and an averaging module to measure the average response time and the average shock magnitude where one or two users hit a target or simulate hitting a target.

In yet another embodiment the present invention provides a method and a device including two or three shock sensors, two shock magnitude display units, an averaging module, a sound module, a tone generator and a microphone to measure the response time and shock magnitude where up to three users hit a target or simulate hitting a target.

In an additional embodiment the present invention provides a method and a device including two shock sensors, two control means, two interface units, a server computer with a modem, a host computer with a modem and a telecommunications link between the two modems to measure the response time and shock magnitude where two users are competing in remote locations hitting a target or simulating hitting a target.

DETAILED DESCRIPTION OF THE INVENTION

Figure 1:
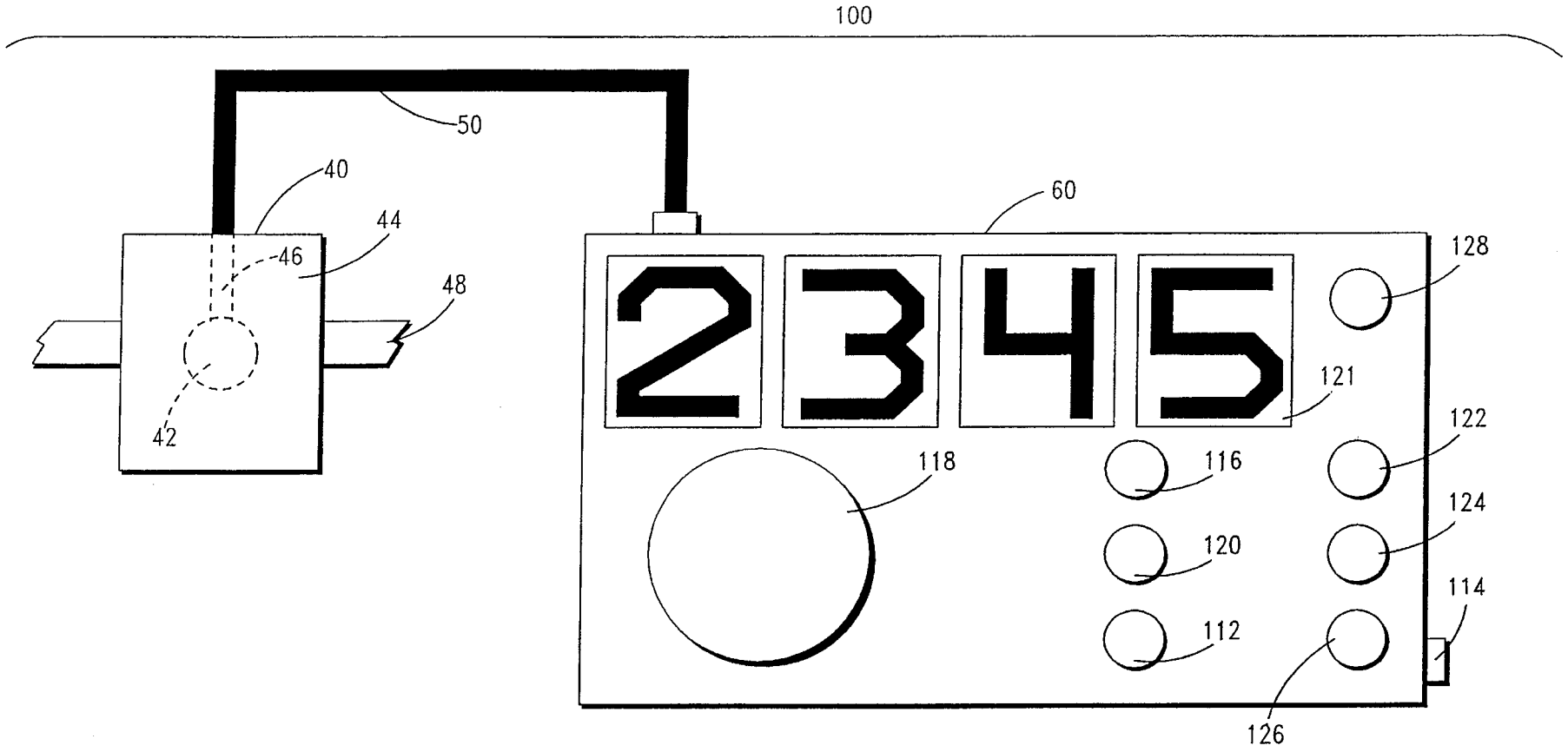
FIG. 1 is a plan view of the top surface of a shock sensor unit and a control means of the present invention.

While describing the invention and its embodiments, certain terminology will be utilized for the sake of clarity. It is intended that such terminology include not only recited embodiments, but all technical equivalents which perform substantially the same function, in substantially the same manner to achieve substantially the same result.

The various embodiments of the present invention utilize one or more shock sensors. As defined herein, a shock sensor is an electrical or electro/mechanical transducer which responds to a shock induced movement of an inertial mass. Inertial mass is herein defined as a mass which has a tendency to remain in a fixed condition of rest or movement. These types of shock sensors are also known as impact sensors, crash sensors, inertia switches, motion switches, tilt switches and acceleration/deceleration sensors. Typically, the sensitivity of shock sensors is expressed as a shock magnitude having a G number wherein G is a standard unit of acceleration or deceleration equal to that due to the earth's gravity.

Examples of shock sensors adaptable for use in the current invention include sensors using inertial mass movement of: electrically conductive liquid, a magnet in a magnetic reed switch, an electrically conductive ball shaped article between contact points, a flexible beam or a pendulum. Some of these shock sensors provide on/off switching while others provide an electrical signal which is proportional to the magnitude of the shock. An electrical effect is generated by the shock sensor as a result of a shock induced movement of the inertial mass of the shock sensor. Suitable examples of electrical effects include: (1) closing a normally open switch, (2) opening a normally closed switch, (3) generating an electrical signal, such as a DC voltage and (4) generating an electrical signal, such as a DC voltage, which is proportional to the magnitude of the shock. Generally, these shock sensors are adapted for use at a predetermined sensitivity level. Shock sensors as defined in the current invention do not include strain gauges, i.e. gauges which rely on strain induced deformation of a material, such as a wire, rod, bar or foil, in response to an applied force. An example of a strain gauge is provided in U.S. Pat. No. 4,534,557 (Bigelow et al., 1985).

U.S. Pat. No. 5,359,162 (Bitko, 1994), herein incorporated by reference, illustrates a shock sensor suitable for the present invention utilizing an electrically conductive liquid. The '162 patent discloses a shock sensor switch having a liquid conductor movable in a housing. A volume of mercury is contained in a recess wherein the mercury is in contact with an electrically conductive support surface. Additional electrical surfaces, insulated from the support surface, make contact with the mercury only as a result of mercury movement in response to a shock, thereby closing an electrical contact between the support surface and the additional surfaces. U.S. Pat. No. 5,194,706 (Reneau, 1993), herein incorporated by reference, illustrates a suitable shock sensor using a magnetically operated reed switch. The '706 patent uses a movable magnet which is biased away from the activation region of the reed switch. When the sensor is exposed to a shock which is sufficient to overcome the spring bias, the magnet moves thereby activating the reed switch. U.S. Pat. No. 5,194,707 (Wallach, 1993), herein incorporated by reference, discloses a suitable shock sensor using a ball movable between contact points. An electrically conductive ball is loosely positioned between a pair of spaced-apart electrically-conductive plates. When the ball is in a condition of rest it makes contact with both plates. A shock causes the ball to break the contact with one of the plates, thus resulting in an open switch between the two plates.

U.S. Pat. No. 5,134,255 (Tetrault et al., 1992), herein incorporated by reference, provides an additional illustration of a shock sensor suitable for the present invention utilizing a movable ball. The '255 patent discloses a miniature acceleration switch wherein a spherical member is movable in a conical guide sleeve. The switch has normally open contacts which are closed by a lightweight movable piston when the ball impinges against the bias of a coil spring. U.S. Pat. No. 4,581,505 (Bal et al., 1986), herein incorporated by reference, discloses a suitable shock sensor utilizing a flexible beam. Upon exertion of the required shock impact, the beam will flex causing contact between the beam and an opposing contact thereby completing an electrical circuit. The force required to make contact can be varied by changing the characteristics of the beam. U.S. Pat. No. 4,581,506 (Bal et al., 1986), herein incorporated by reference, discloses an alternate flexible beam impact switch utilizing a piezoelectric crystal which is located on the contact side of the flexible beam. The appropriate inertial load when applied to the weighted beam, causes the beam to flex resulting in contact between the piezoelectric crystal and a pin thereby providing a voltage. The more pressure is applied to the crystal the larger the output voltage of the crystal. As a result an analog signal is produced by the piezoelectric crystal which is proportional to the shock impact.

U.S. Pat. No. 4,536,629 (Diller, 1985), herein incorporated by reference, discloses a gas damped acceleration switch illustrating a suitable shock sensor wherein the sensor sensitively is selectively affected by damping of the inertial mass movement. The '629 patent provides a spring-loaded mass, such as a rod, which is supported for movement along an axis. The mass is movable in response to a shock. Gas damping is provided by a flat disk supported on the moving mass. U.S. Pat. No. 4,384,269 (Carlson, 1983), herein incorporated by reference, illustrates a shock sensor wherein the movable mass is a pendulum used in a vehicle acceleration/deceleration warning system. Angular displacement of the pendulum due to acceleration or deceleration changes the amount of light received by a photocell resulting in a change of an electrical quantity which is proportional to the rate of acceleration or deceleration of the vehicle. The pendulum is provided with mechanical and magnetic damping.

While shock sensors suitable for the current invention have been described with reference to the above patents it will be understood that the invention is not limited to the shock sensors of the above referenced patents since these are merely illustrative of suitable types of shock sensors. The present invention is equally operable with other shock sensors employing a movable inertial mass including for example flexible beam shock sensors employing a piezoelectric strip along the beam, wherein flexing of the beam caused by shock results in flexing the piezoelectric strip, thereby generating an electrical voltage which is proportional to the shock impact. This type of shock sensor is commercially available as type OCH-04-08 from AMP Incorporated, Valley Forge, Pa..

One embodiment of the present invention is illustrated in FIG. 1, showing an athletic performance evaluating device 100 wherein a shock sensor unit 40 is operatively connected to a control means 60. A communicating means 50 provides the operable connection between the shock sensor unit 40 and the control means 60. Shock sensor unit 40 comprises a shock sensor 42 enclosed in a sensor housing 44. Conventional electrical connections 46 provide the operative connection between the shock sensor 42 and the communicating means 50. Preferably, the sensor housing is equipped with a sensor fastening means 48 to fasten sensor unit 40 to a member, such as a person or to an object. Suitable fastening means include stretchable and non-stretchable belts or straps with or without a clasp, buckle or hook-and-loop fastener. Preferably, sensor unit 40 is sealed to protect the shock sensor 42 from dust and atmospheric contamination.

Figure 2A:
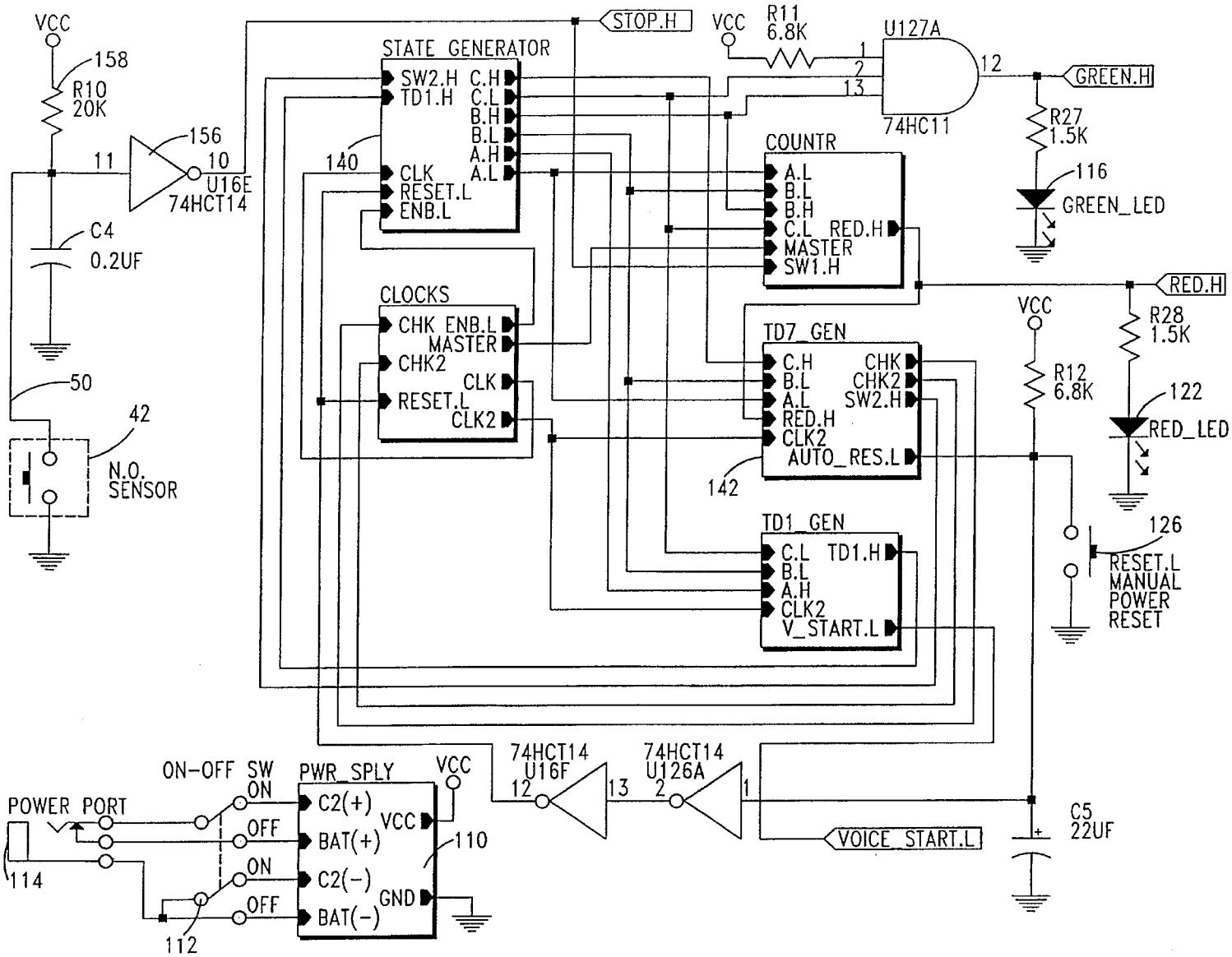
FIG. 2A shows a block diagram and a schematic circuit diagram illustrating one embodiment of the shock sensor unit and control means of the device of FIG. 1.

Referring to FIGS. 1 and 2A, control means 60 is provided with various functions for input, output, signal processing, cycle processing and reporting. Shock sensor 42, has normally open contacts. These contacts will close as a result of a physical shock to shock sensor unit 40 when the shock magnitude equals or exceeds the predetermined sensitivity level of shock sensor 42. Closure of the contacts of shock sensor 42 is an electrical effect which is communicated to control means 60 through communicating means 50.

The electrical components of control means 60 are connected to a conventional power supply means, such as power supply 110 when on-off switch 112 is in the on position (FIG. 2A). Suitable power sources include batteries and external power sources connected to control means 60 through port 114.

Figure 10:
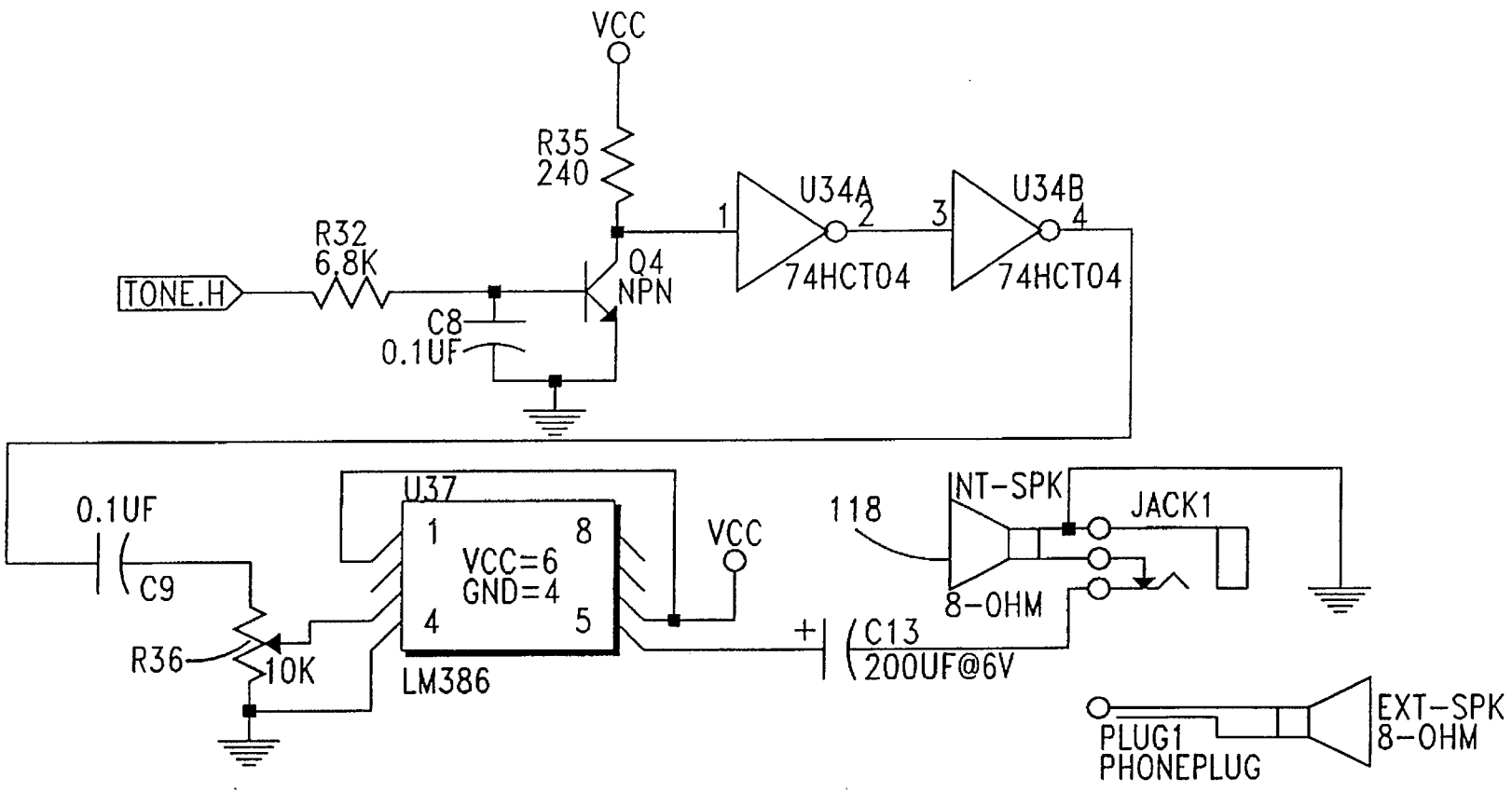
FIG. 10 is a schematic circuit diagram of the audio block diagram of FIG. 7.
Figure 11:
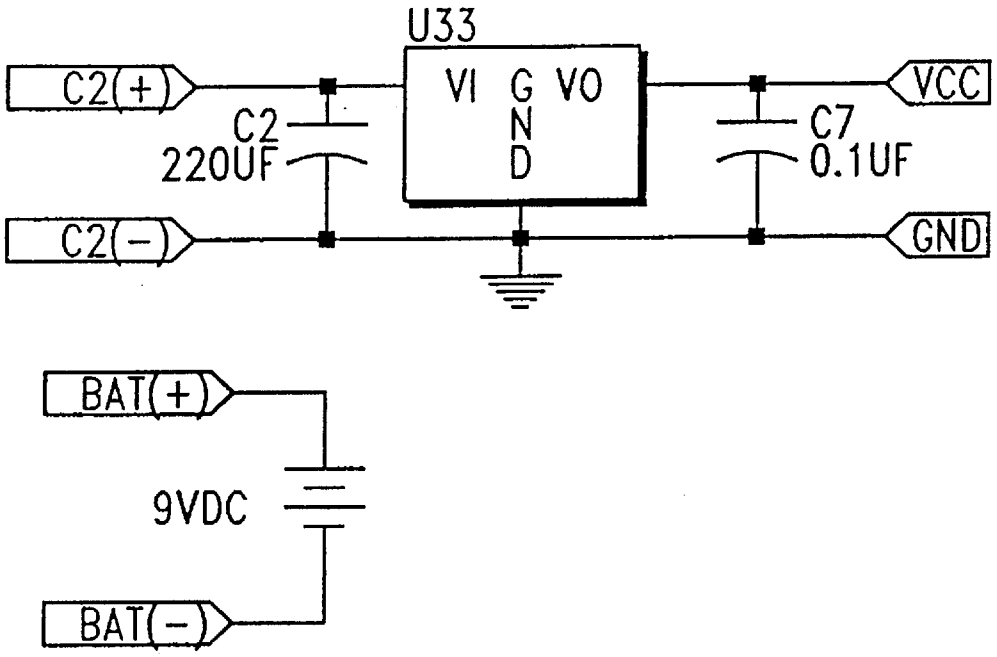
FIG. 11 is a schematic circuit diagram of the power supply of FIG. 2A.

Closure of the contacts of shock sensor 42 is an electrical effect which is detected by control means 60 only when the performance evaluating device is in a ready state. Control means 60 indicates that is in a ready state when a first light such as a green LED ready light 116 is lit (FIG. 1). Alternately, a ready state can be indicated by both light 116 and a tone generated at speaker 118. LED-tone & LED selection switch 120 is used to select the ready state indicator as either light 116 or light 116 combined with a tone from speaker 118 (FIG. 10). Thus, ready state indicators include (1) visual indicators, such as a first light, (2) audio indicators, such as a tone and (3) audio-visual indicators, such as combinations of visual and audio indicators. The ready state is ended when control means 60 detects an electrical effect which is generated by shock sensor 42. The end point of the ready state is indicated when a second light such as a red LED stop light 122 is lit. Alternately the end of the ready state is indicated by a combination of light 122 and the ending of the tone from speaker 118. The ready state end point indicator mode is selected by using the LED-tone & LED switch 120. Thus, ready state end point indicators include (1) visual indicators, such as a second light, (2) audio indicators such as ending of a tone and (3) audio-visual indicators such as combinations of visual indicators and audio indicators. Display 121 shows the elapsed time between the beginning and the ending of the ready state, as will be described below.

Figure 5:
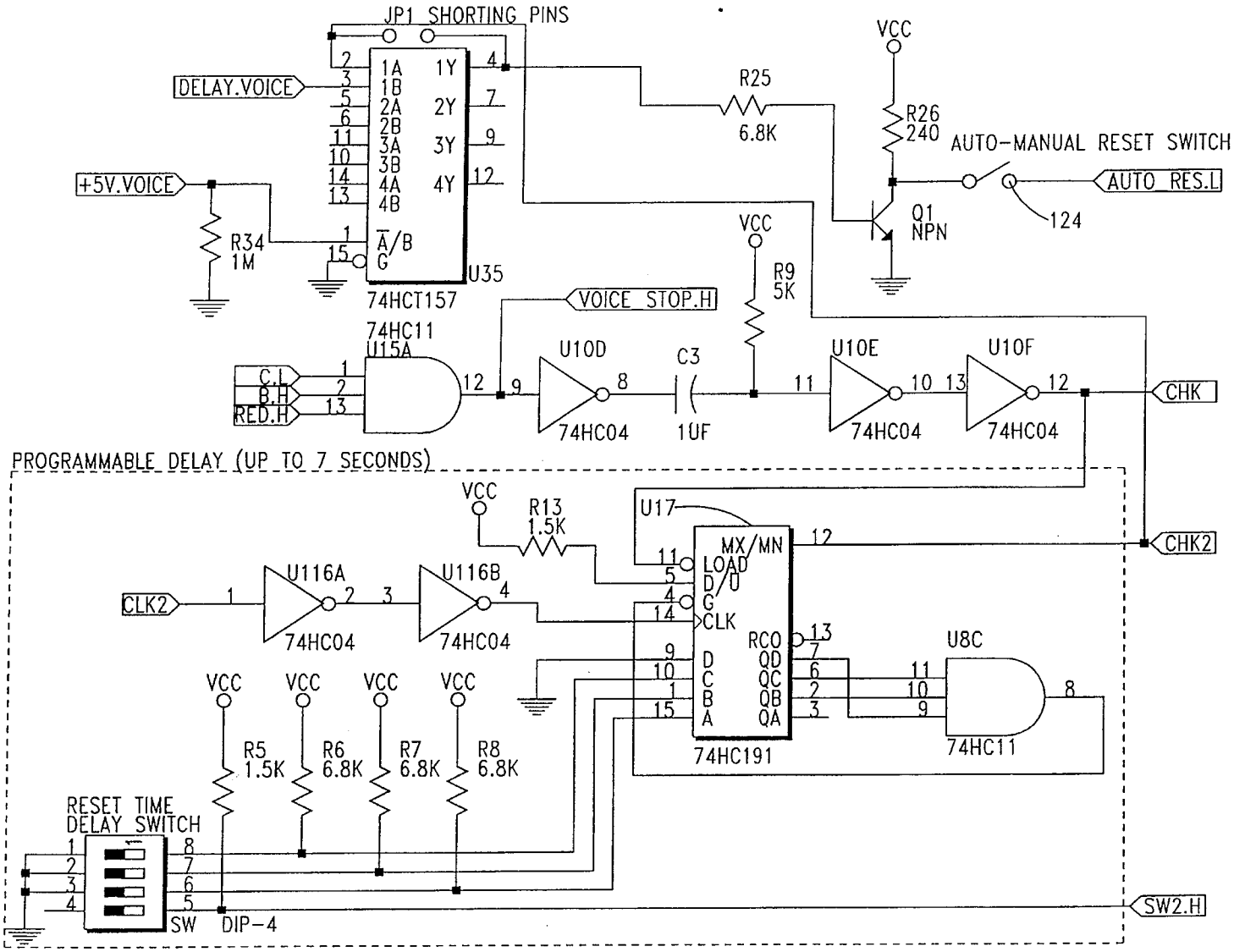
FIG. 5 is schematic circuit diagram of a logic circuit of FIG. 2A.

The ready state can be generated manually or automatically through a ready state generator using a cycle selection means such as conventional selection switch 124 shown in FIGS. 1 and 5. In the manual mode of switch 124, a ready state is obtained by contacting reset switch 126 (FIGS. 1 and 2A) while on-off switch 112 is in the on position. The ready state generator is used to obtain automatic generation of the ready state by initializing reset switch 126 while switch 124 is in the auto position and switch 112 is in the on position. Automatic generation of the ready state results in a delay state prior to the beginning of the ready state. The delay state is a random time period ranging from for example 4 seconds to 11 seconds.

Figure 3:
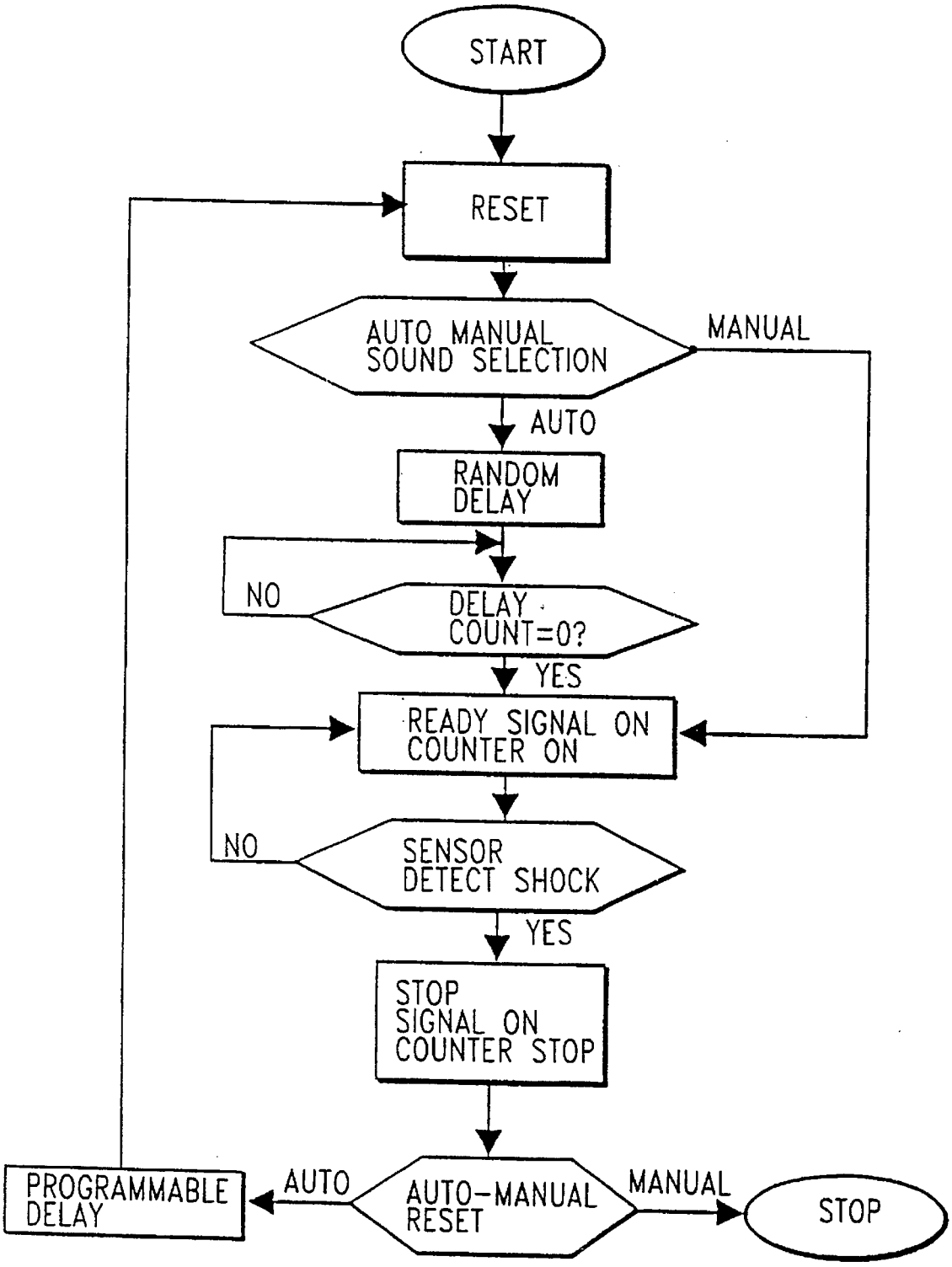
FIG. 3 is a flowchart illustrating the function of one of the embodiments of the device of FIG. 1.
Figure 4:
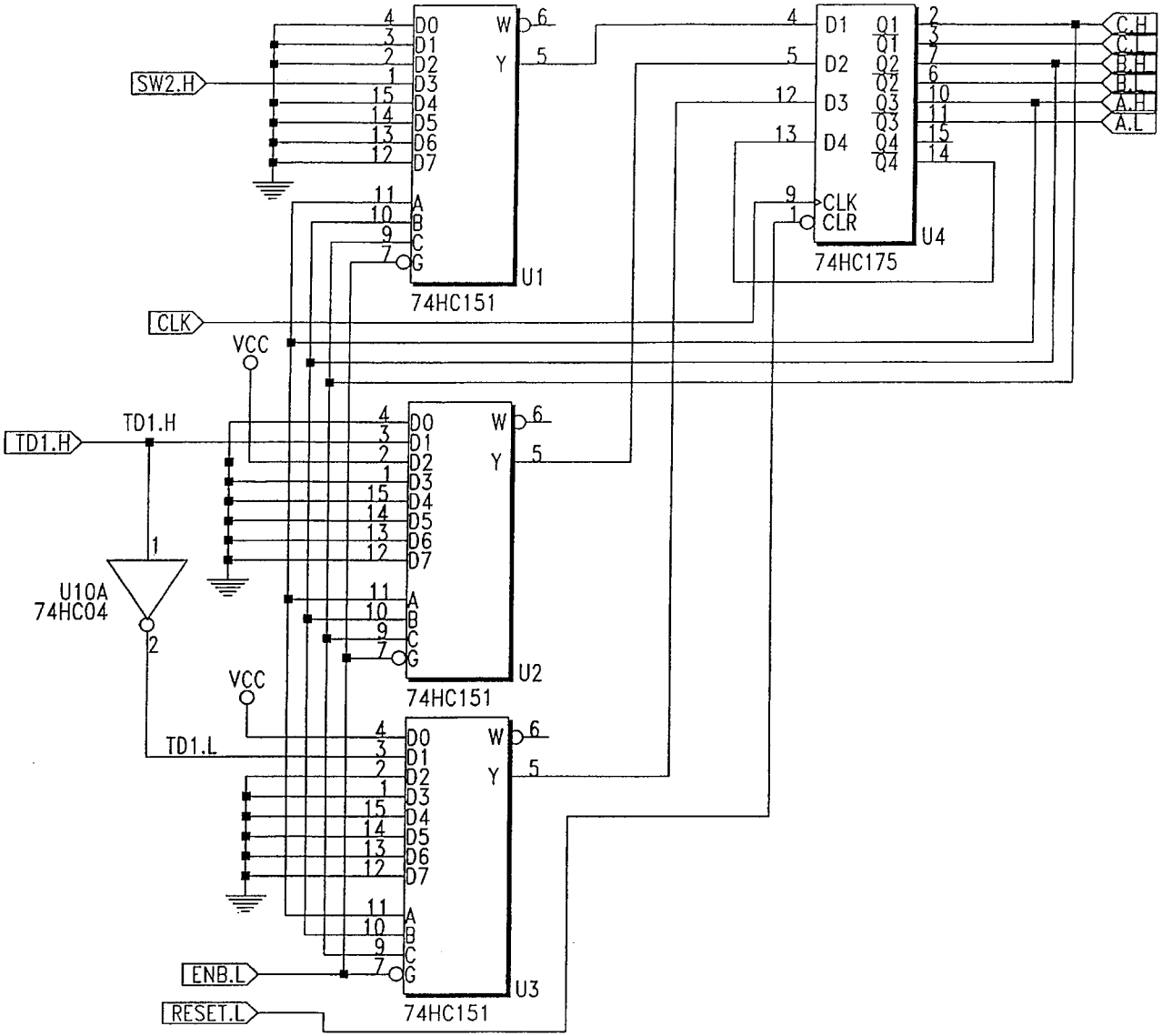
FIG. 4 is schematic circuit diagram of a state generator of FIG. 2A.
Figure 6:
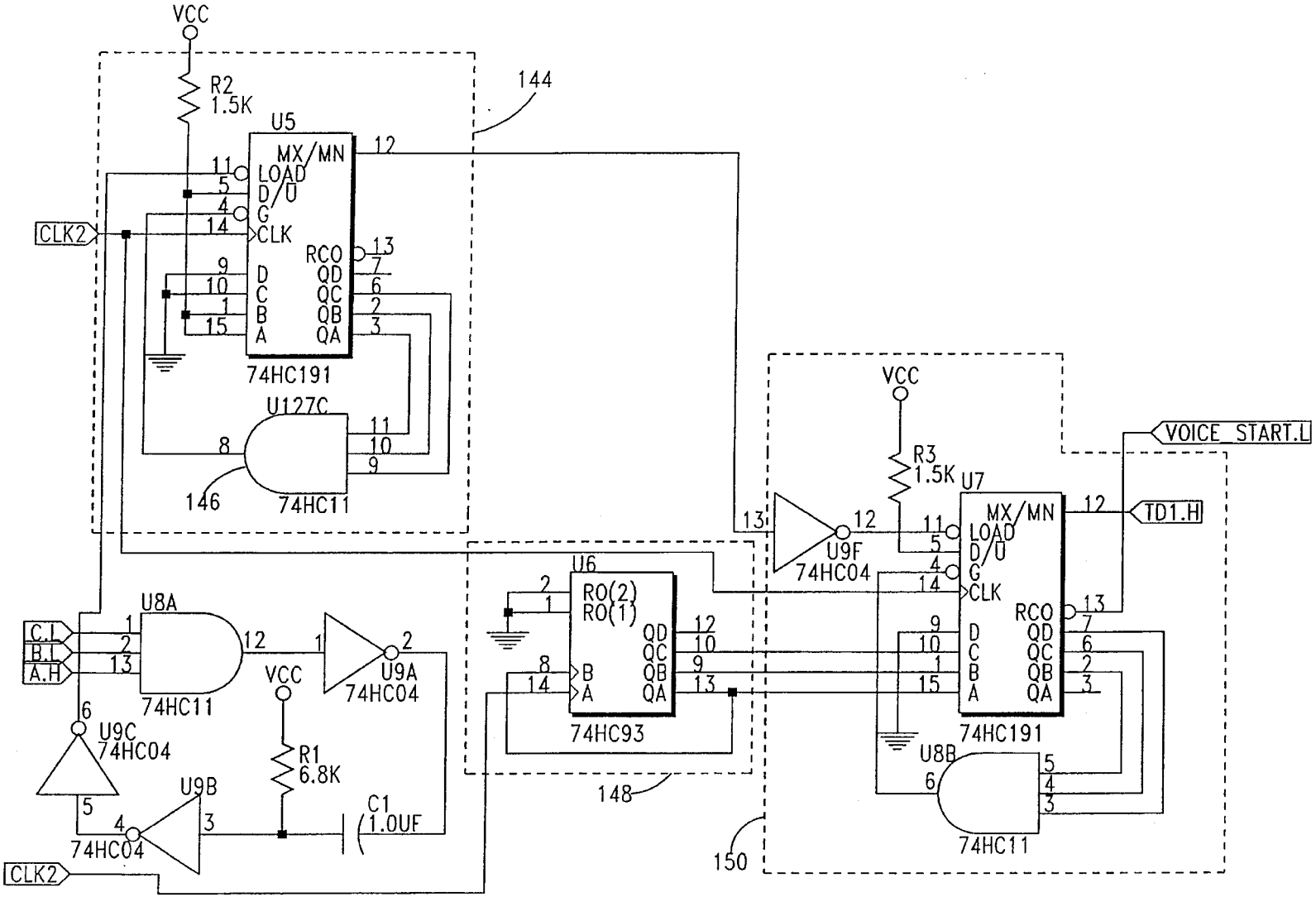
FIG. 6 is a schematic circuit diagram of a logic circuit of FIG. 2A.

Control means 60 has five different states, i.e.: reset, random delay, ready signal, stop signal and programmable delay as summarized in FIG. 3. The different states are generated by a conventional state generator 140 (FIGS. 2A and 4). When auto-manual switch 124 (FIG. 5) is in the auto position, delay state generator logic circuit 142 (FIG. 2A) will generate a random delay state prior to the ready state. A suitable random delay for device 100 ranges from about 4 seconds to about 11 seconds. The 4 second delay is generated by a conventional counter 144 and AND gate 146 shown in FIG. 6. A conventional random number generator 148 counts binary coded decimals 0 to 7 at a rate of 1 Hz and loads these binary digits to the input of counter 150 at the end of 4 seconds. Counter 150 then counts down to 0 at a rate of 1 Hz thus providing a random delay state ranging from 4 to 11 seconds.

At the end of the above count, the first light ready LED 116 is lit thereby alerting the user of device 100 that the device is in the ready state. At the same time, master clock signal 154 (FIG. 7) starts counting and a response time display 121 (FIGS. 1 and 7) starts running. The clock 154 and response time display will continue to count until control means 60 detects the electrical effect which is generated by shock sensor 42 (FIGS. 1 and 2A), as will be described below.

Figure 7:
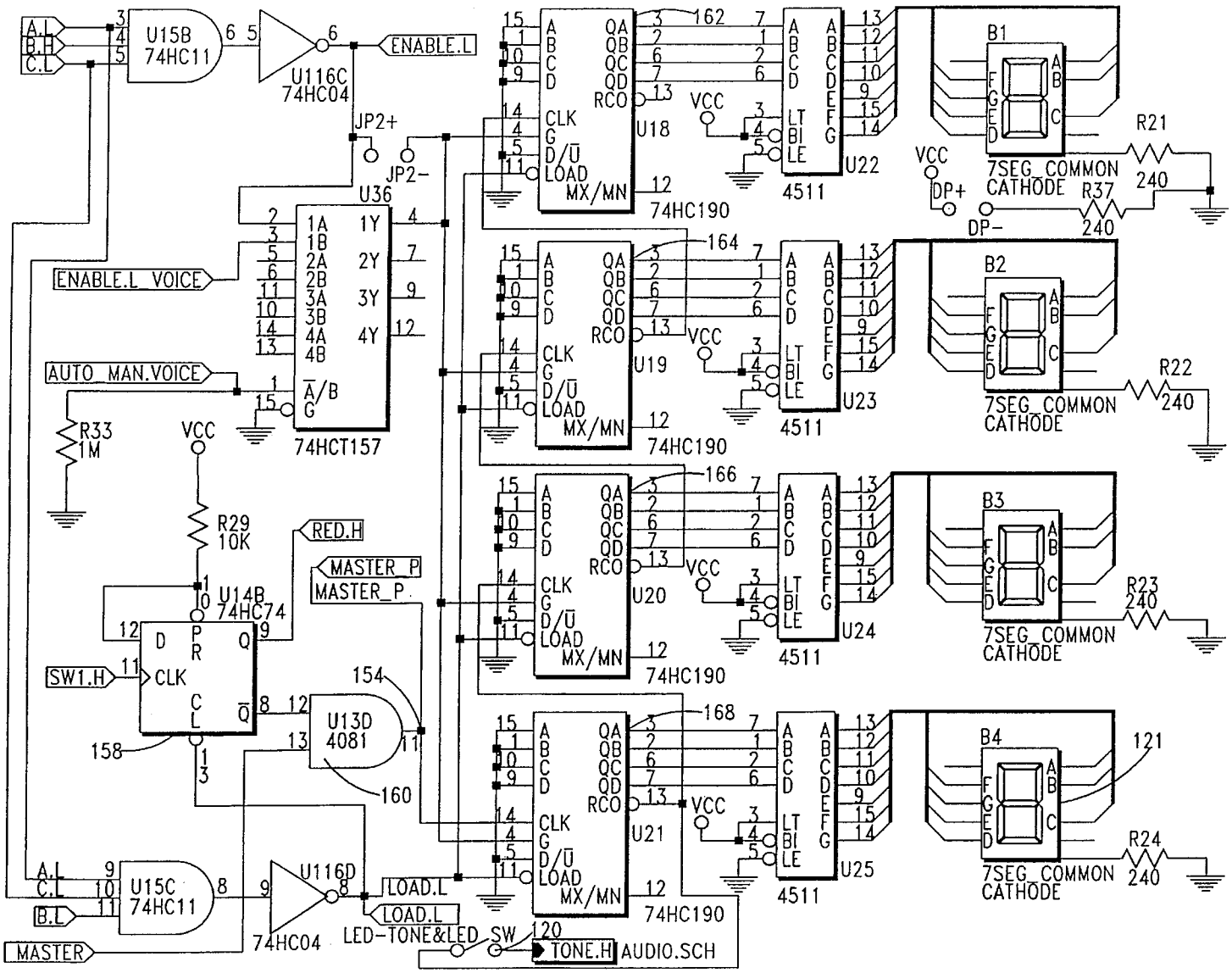
FIG. 7 is a schematic circuit diagram of a counter of FIG. 2A.

When shock sensor 42 detects a shock which equals or exceeds the shock sensor sensitivity level, the contacts of this sensor will close thus generating an electrical effect. This electrical effect is processed by an electrical effect processing means which generates a low logic signal forcing the input of inverter U16E (FIG. 2A) to ground (FIG. 2A). The pull-up resistor 158 and the capacitor C4 (FIG. 2A) of the electrical effect processing means keep the input of the inverter 156 charged up to VCC. The electrical effect discharges the capacitor C4 causing an instantaneous low logic signal. When contact closure is detected, a return-to-one (RTO) signal is generated in the input of inverter 156 and a return-to-zero (RZ) is generated at the output. When the rising edge of the RZ signal is detected by the input of D-FF 158 (FIG. 7), a logic one is latched to the output Q (RED. H), causing the red LED 122 (FIG. 1) to light. The complementary output Q/(Q-NOT) latches a logic zero (or low logic) thus disabling the master signal from clocking the display driver 168. The other display drivers 166, 164 and 162 are clocked in ripple manner in which their clock source comes from display driver 168 (FIG. 7).

The elapsed time between the beginning and ending of the ready state is an athletic performance result showing the user's response time or reaction time. An athletic performance reporting means reports the elapsed time. The athletic performance reporting means of device 100 comprises an LED number display 121 (FIG. 1). Display 121 counts and reports elapsed time continuously until the ready state is ended at which time the master clock signal 154 (FIG. 7) stops counting and display 121 shows the user's response time or reaction time. An alternate athletic performance reporting means comprises an LCD number display (not shown) or numbered lights (as will be described in connection with FIG. 18 of device 800) wherein each numbered light represent a specific time interval such as, for example, 50 milliseconds (ms).

The auto manual-selection switch 124 (FIGS. 1 and 5) controls the resetting of state generator 140 (FIG. 2A). If manual is selected, the push-button reset must be contacted to reset the state generator 140.

A programmable reset delay ranging from 0 seconds to 7 seconds can be selected by selecting the proper switch position of DIP-4 switch shows in FIG. 5. The DIP-4 switch controls the input of the U17, where it can be set as shown in the following Table 1, wherein 1 denotes open and 0 denotes closed.

TABLE 1

| sw1 | sw2 | sw3 | Reset Delay (sec.) |
|---|---|---|---|
| 0 | 0 | 0 | 0 |
| 0 | 0 | 1 | 1 |
| 0 | 1 | 0 | 2 |
| 0 | 1 | 1 | 3 |
| 1 | 0 | 0 | 4 |
| 1 | 0 | 1 | 5 |
| 1 | 1 | 0 | 6 |
| 1 | 1 | 1 | 7 |

The ready state tone is generated by closing switch 120 (FIG. 7). The tone is generated by output signal RCO from display counter 168 (FIG. 7) which is one tenth of the frequency of the master clock signal. The signal is amplified as shown in the circuit diagram of FIG. 10, by the amplifier/driver integrated circuit LM386 which is used to drive the internal speaker, $INT_{13}$ SPK (118). Variable resistor R36 (FIG. 10) controls the volume of the speaker. An output jack (FIG. 10) is also provided for an external speaker.

Control means 60 is equipped with a plurality of ports as followers. A first port provides the operative connection between the communicating means 50 and control means 60 at the input of inverter U16E (156). A second (optional) port provides the operative connection of control means 60 to the output of a sound module 62, as will be described in connection with FIG. 12. A third (optional) port provides the operative connection to the output of a shock magnitude display unit 80, as will be described in connection with FIG. 13. A fourth (optional) port provides the operative connection to the output of an averaging module 75, as will be described in connection with FIG. 14. A fifth (optional) port provides the operative connection to the output of a shock magnitude display unit 92 which has an additional display for response time, as will be described in connection with FIG. 15.

Additional ports of control means 60 include a sixth port 114 (FIG. 1) for an external DC power supply and a seventh port for an external loudspeaker, see FIG. 10.

The control means 60 pin connections for the second port are shown in the following table.

TABLE 2

| PIN | SIGNAL | PIN NUMBER |
|---|---|---|
| 1 | STOP.H | U16E/P010 |
| 2 | ENABLE.L | U116C/P006 |
| 3 | ENABLE.L (VOICE) | U36/P003 |
| 4 | MUX SELECT | U36/P001 |
| 5 | MASTER | U13D/P013 |
| 6 | VSS | GROUND |
| 7 | LOAD.L | U116D/P008 |
| 8 | AUTO_RESET_DELAY | U35/P003 |
| 9 | MODULE + 5VDC | U35/P001 |
| 10 | MV/G | |

The control means 60 pin connections for the third, fourth and fifth port are shown in the following Table 3.

TABLE 3

| PIN | SIGNAL | PIN NUMBER |
|---|---|---|
| 1 | STOP.H | U16E/P010 |
| 2 | ENABLE.L | U116C/P006 |
| 3 | ENABLE.L(VOICE) | U36/P003 |
| 4 | CLK_1SEC.H | U26/P013 |
| 5 | MASTER | U13D/P013 |
| 6 | VSS | GROUND |
| 7 | LOAD.L | U116D/P008 |
| 8 | VCC | POWER |
| 9 | MODULE + 5VDC | U35/P00I |
| 10 | MV/G | |

Figure 2B:
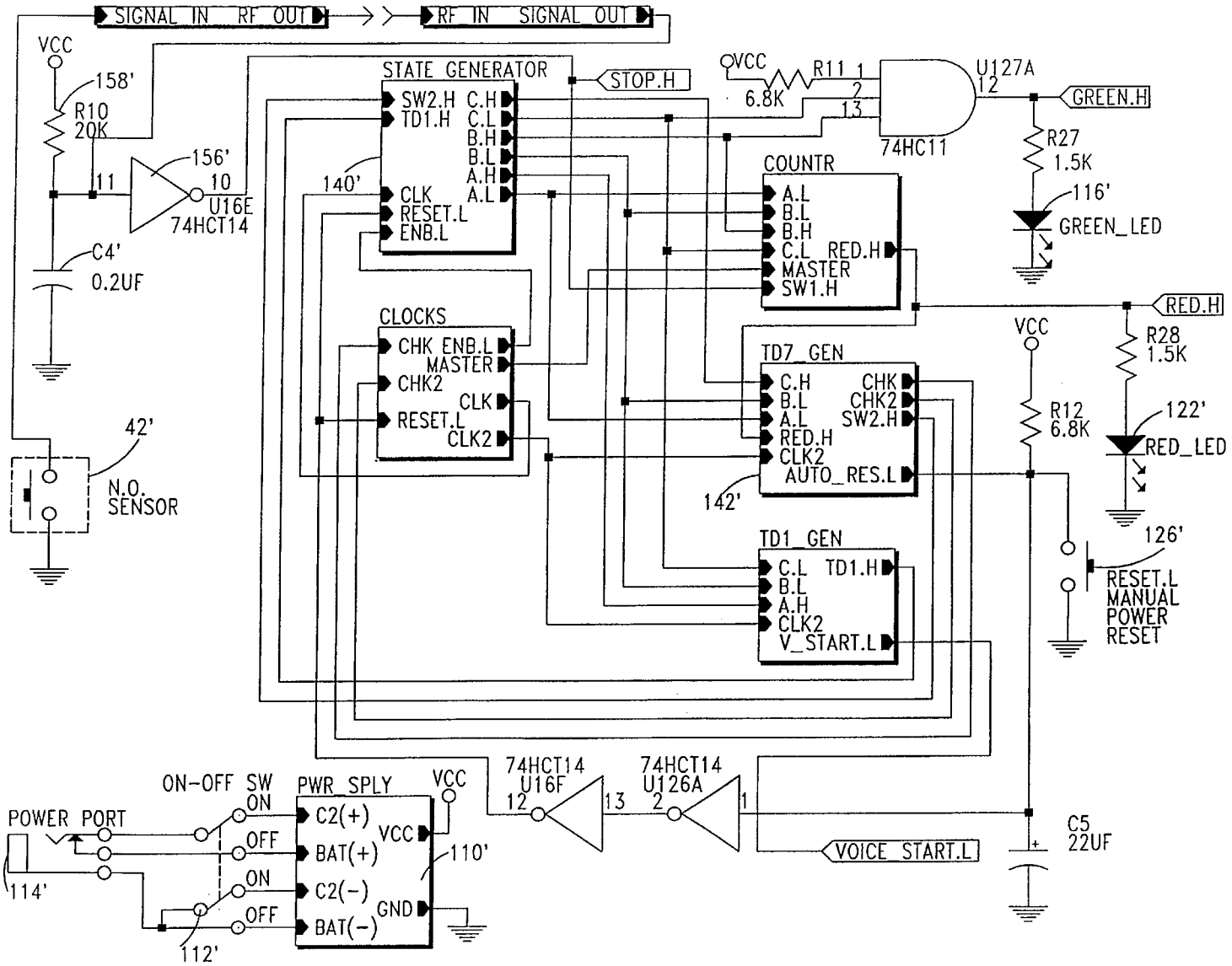
FIG. 2B shows a block diagram and a schematic circuit diagram illustrating an alternate embodiment of the device of FIG. 1.

An alternate embodiment of athletic performance evaluating device 100 utilizes a wireless electrical connection between shock sensor unit 40 and control means 60. In this alternate embodiment, shock sensor 42 is hard wired to a conventional wireless transmitter like those used in remote garage door openers, wherein the usual push button is replaced by the contacts of shock sensor 42. The wireless transmitter and shock sensor are enclosed in a housing, preferably equipped with a sensor fastening means similar to fastening means 48 shown in FIG. 1. Control means 60 is equipped with an antenna 128 to receive the shock sensor transmitter signal. FIG. 2B shows a modification of the circuit diagram incorporating a typical wireless receiver circuit indicated as RF units.

Figure 2C:
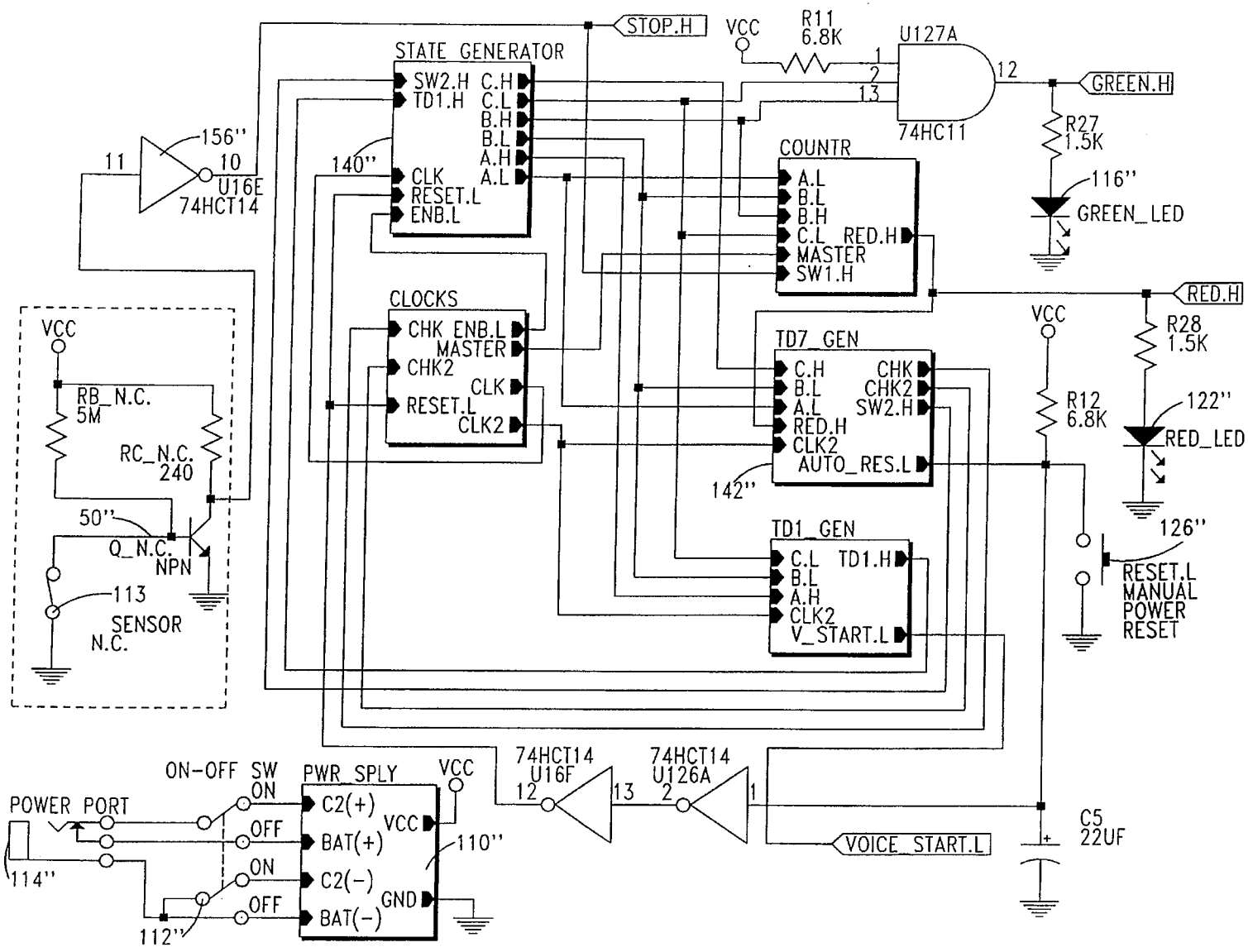
FIG. 2C shows a block diagram and a schematic circuit diagram illustrating an alternate embodiment of the device of FIG. 1.

In yet another alternate embodiment of device 100, a shock sensor 113 (FIG. 2C) is utilized in which the sensor has normally closed contacts which are opened when the shock sensor is subjected to a shock impact which equals or exceeds the shock sensor's sensitivity level, thereby generating an electrical effect. Referring to FIG. 2C, Q_N.C. will remain turned off when the sensor contacts are closed thus the collector, Vout, will be at logic one (high logic). The moment the sensor switch opens, pull-up resistor, RB_N.C., will charge the base of Q_N.C. and when the base voltage is at least 0.7 Volts, Vout will become logic zero for at least the duration of the switch being open, thus a Return-To-One signal is achieved.

Figure 12:
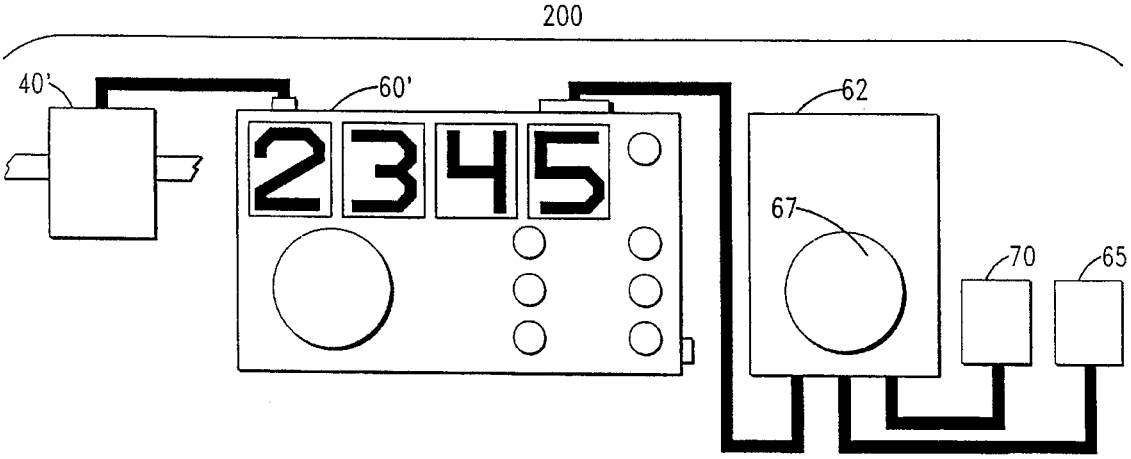
FIG. 12 shows an alternate embodiment of the present invention including a sound module.

An alternate embodiment of the present invention is shown in FIG. 12. Athletic performance evaluating device 200 comprises (1) a shock sensor unit 40' similar to the shock sensor unit 40 of device 100, (2) a control means 60' similar to control means 60 of device 100 but additionally having a second port as described in connection with control means 60 of device 100, (3) a sound module 62 having a speaker 67, (4) a tone generator 65 (5) a microphone 70 and (6) appropriate connecting means. Sound module 62 in FIG. 12, processes counter display data and performs Digital-to-Analog (D/A) conversion and broadcasts time measurements through its built-in speaker or to an external speaker or tone generator 65 for further amplification. The microphone 70 can be used to accept and record voice signals to generate the ready state signal generated by a person to replace the tone ready signal.

Figure 13:
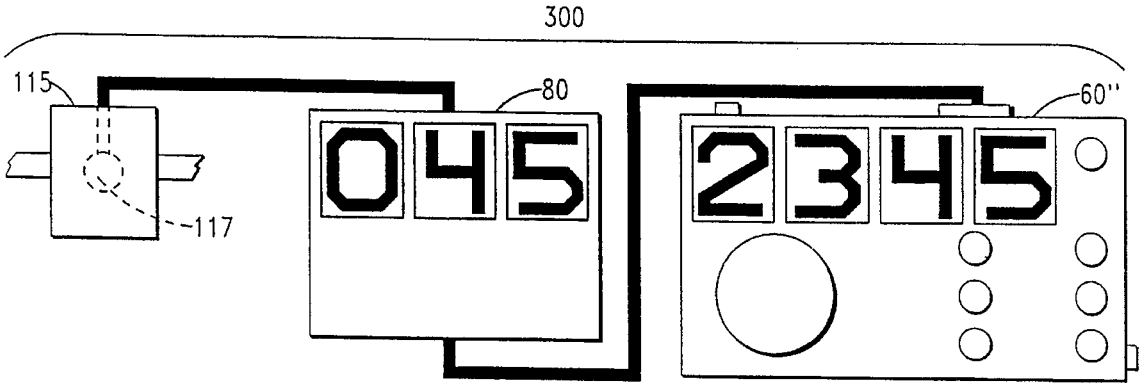
FIG. 13 shows an alternate embodiment of the present invention including a shock magnitude display unit.

A further alternate embodiment of the present invention is shown in FIG. 13. Athletic performance evaluating device 300 comprises (1) a shock sensor unit 115 (2) a control means 60" similar to control means 60 but additionally having a third port as described in connection with control means 60 of device 100, (3) a shock magnitude display unit 80, and (4) appropriate connecting means. Shock sensor unit 115 includes a shock sensor 117 which generates an electrical effect as a voltage which is proportional to the magnitude of the shock. Shock magnitude display unit 80 displays the shock magnitude which is generated by shock sensor 117 as a result of the athletic activity of the person using the shock sensor unit 115.

Figure 2D:
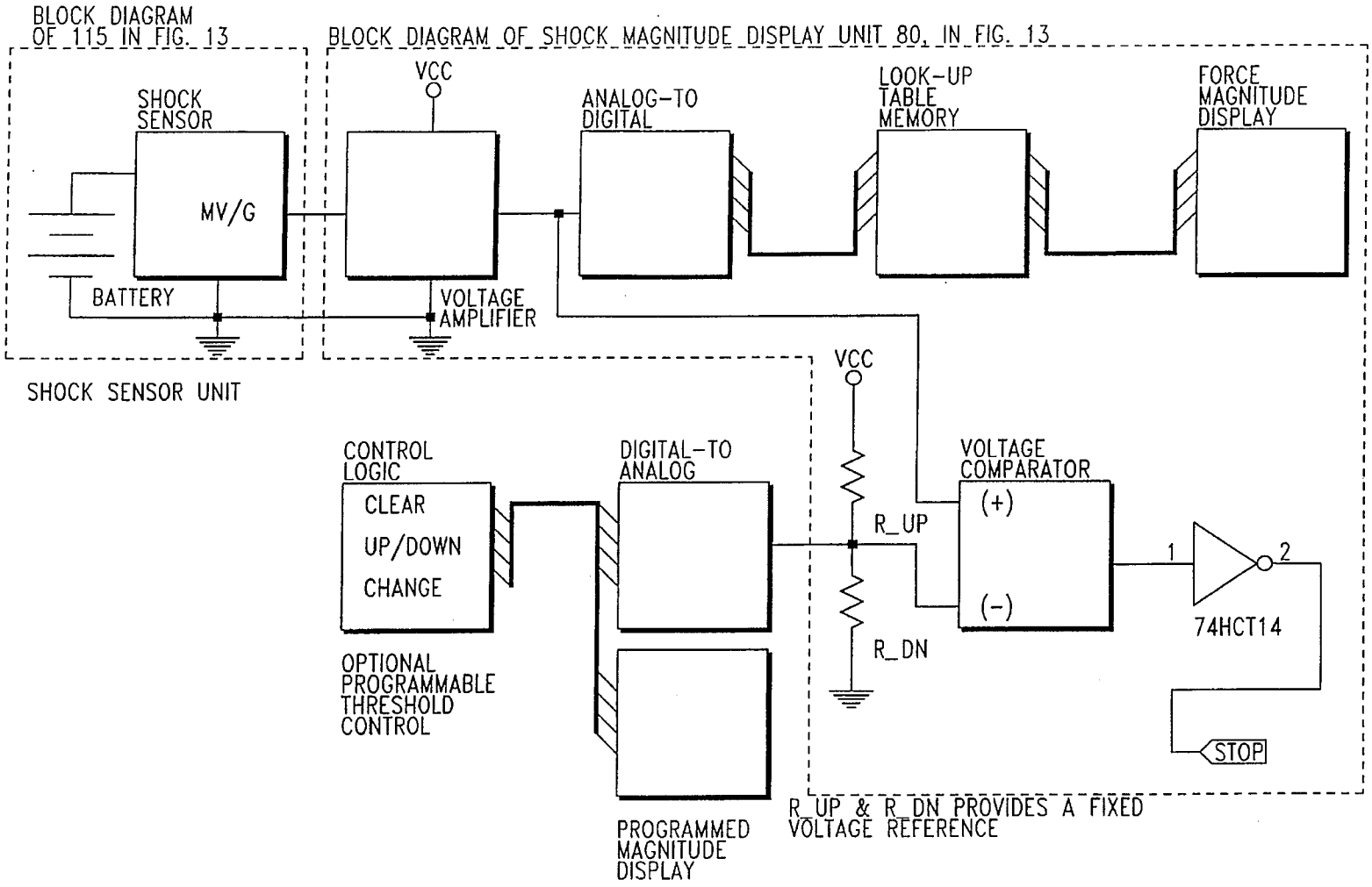
FIG. 2D shows a block diagram and a schematic circuit diagram illustrating and alternate embodiment of the device of FIG. 1.

Device 300 functions as follows. The voltage generated by shock sensor 117 as a result of a physical shock is the electrical effect which is communicated to the shock magnitude display unit 80 via a hard wire connection. The analog signal is amplified by a conventional amplifier of unit 80 (FIG. 2D). The amplified analog signal is then converted to a digital signal by the conventional converter shown in FIG. 2D. The digital signal is then used as an address in the memory where the shock measurement is stored in a conventional look-up table memory. The shock magnitude corresponding to the electrical effect generated by the shock is then displayed on unit 80.

Figure 2E:
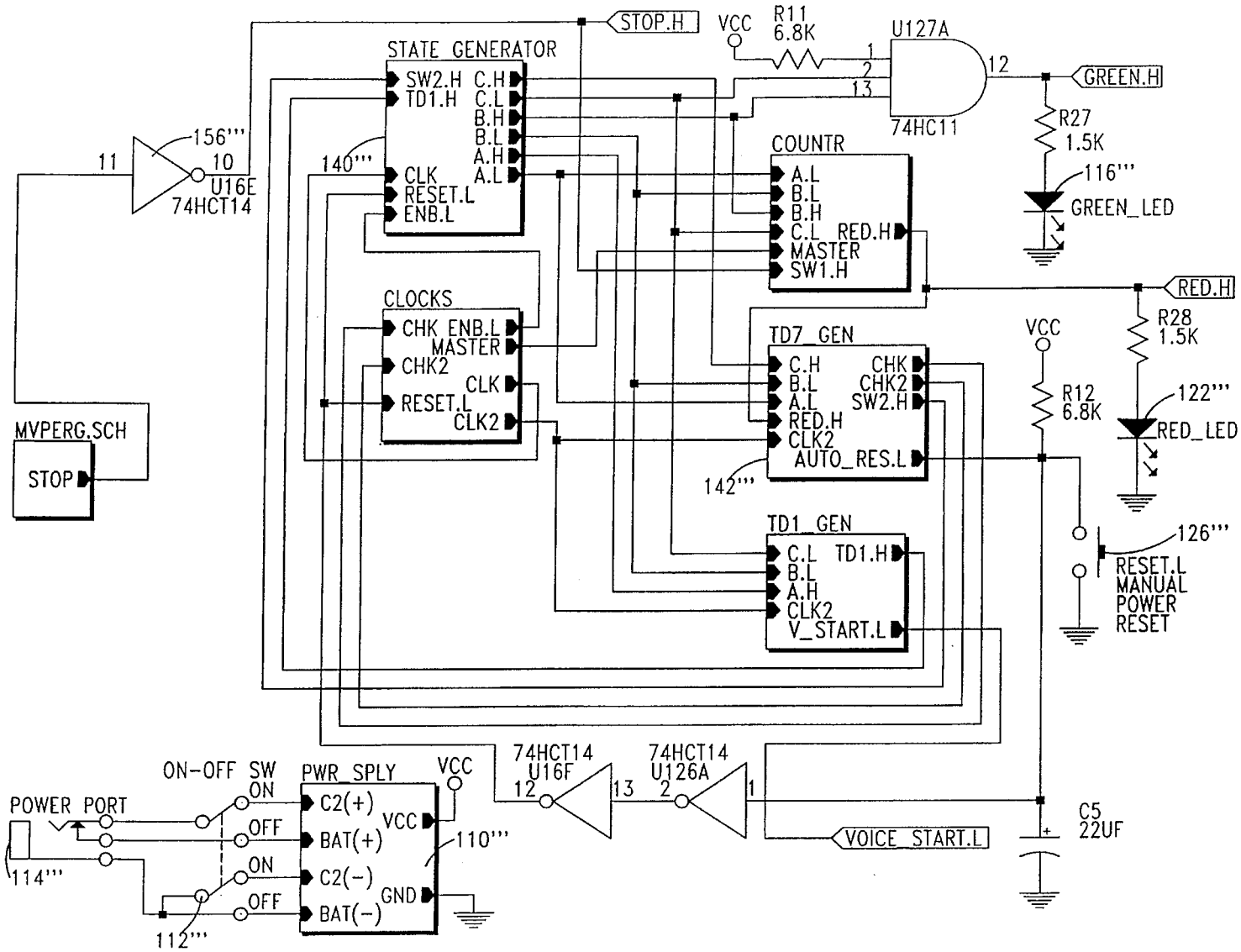
FIG. 2E shows a block diagram and a schematic circuit diagram illustrating and alternate embodiment of the device of FIG. 1.

The amplified signal is also compared with a fixed reference voltage comparator (FIG. 2D). If the value of the amplified signal is less than the reference voltage, the STOP signal value is a logic "one". If the value of the amplified signal is greater than the reference voltage the STOP signal value is a logic "zero", which is required to generate an RTO signal at the output of the Schmidt-Triggered Inverter which is used to condition the output of the comparator. The logic zero, thus generated, disables the master signal from clocking the display counter (FIG. 2E). The fixed reference voltage can be modified if needed as a user option for controlling a shock magnitude threshold value. For example, the user may want to set a minimum shock magnitude as a goal for a particular training exercise, using this minimum shock magnitude as the threshold value. The shock magnitude value is displayed on unit 80.

Figure 2F:
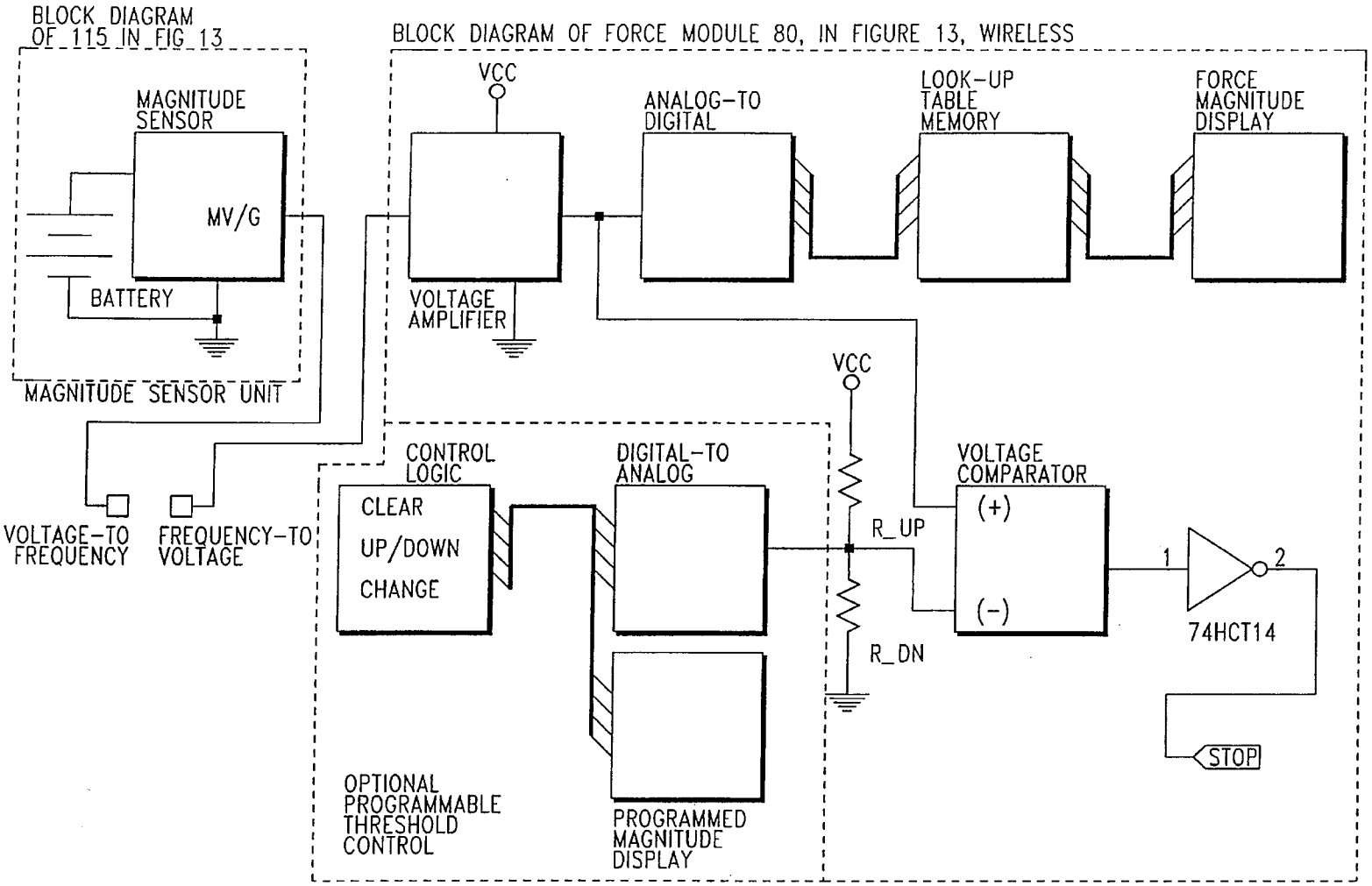
FIG. 2F shows a block diagram and a schematic circuit diagram illustrating and alternate embodiment of the device of FIG. 1.
Figure 2G:
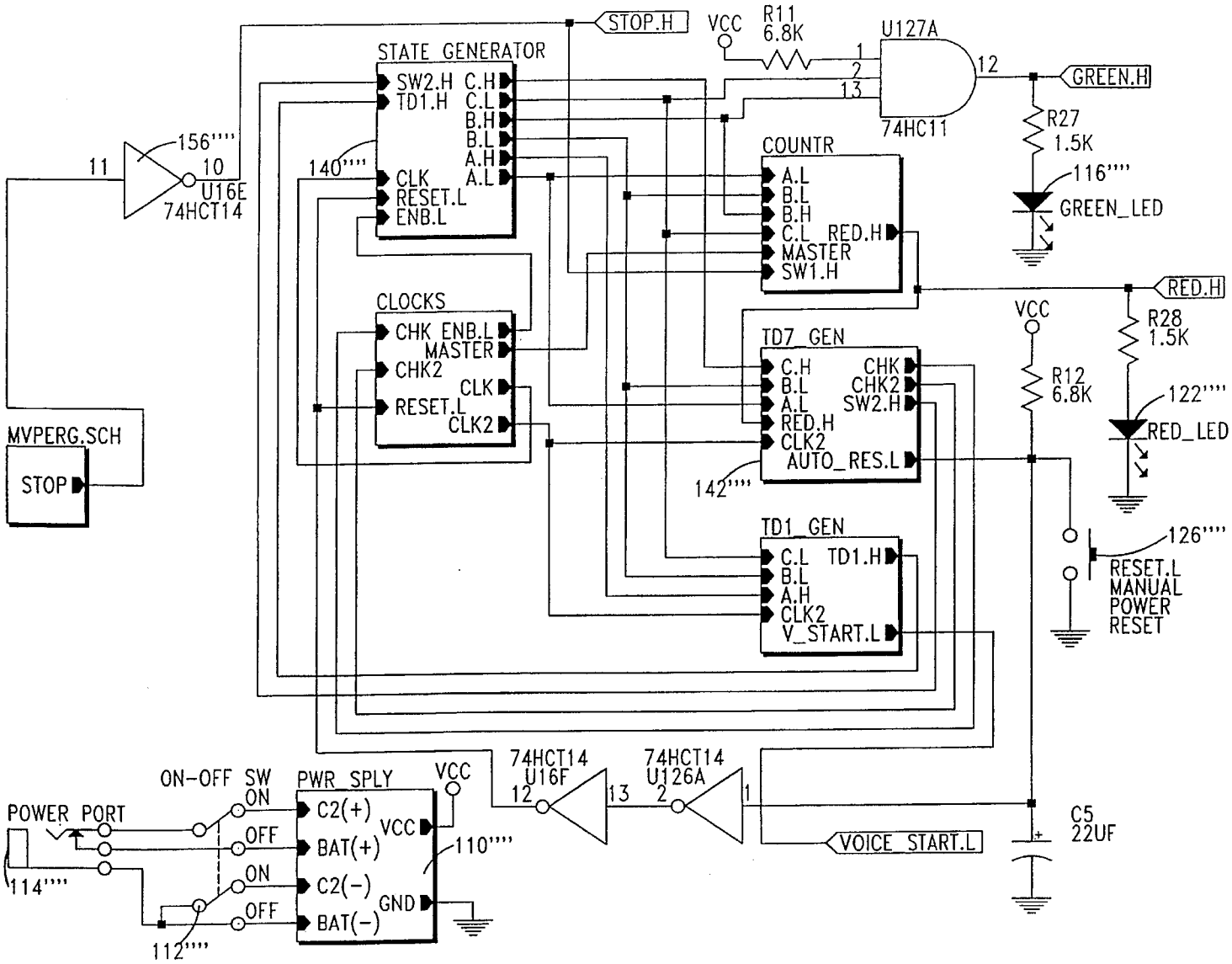
FIG. 2G shows a block diagram and a schematic circuit diagram illustrating and alternate embodiment of the device of FIG. 1.

Alternately, performance evaluating device 300 can be modified to utilize a wireless communicating means between the shock sensor unit 115 and the shock magnitude display unit 80. This is illustrated in FIGS. 2F and 2G using conventional circuits and conventional components.

Figure 14:
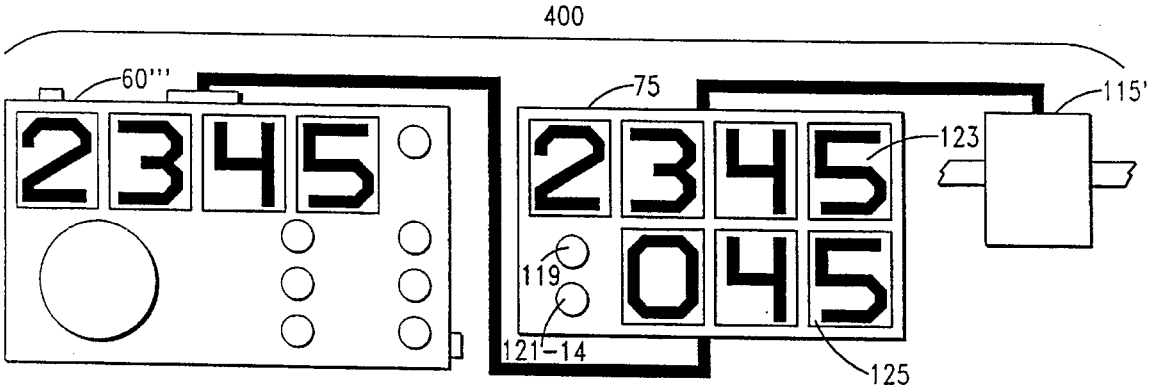
FIG. 14 shows an alternate embodiment of the present invention including an averaging unit.

An additional alternate embodiment of the current invention is shown in FIG. 14, wherein athletic performance evaluating device 400 comprises (1) a shock sensor unit 115' similar to shock sensor unit 115, (2) a control means 60''' similar to control means 60 but additionally having a fourth port as described in connection with control means 60 of device 100, (3) an averaging module 75 and (4) appropriate connecting means. The averaging module 75 displays elapsed time and shock magnitude per event as well as averaged elapsed time and average shock magnitude when the AVG button 119 of the averaging module 75 is pressed. The reset button 121-14 of averaging module 75 clears the displays 123 and 125 and the data storage memories. Optionally, two athletes can use device 400 simultaneously when a second shock sensor unit 40" (not shown) similar to shock sensor 40 of device 100 is connected to control means 60'''.

Figure 15:
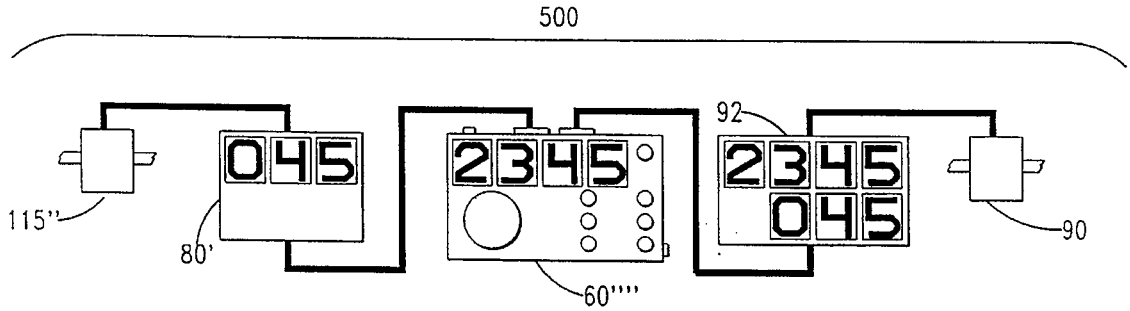
FIG. 15 shows an alternate embodiment of the present invention including a first and second shock sensor unit, and a first and second shock magnitude display unit.

Still another alternate embodiment of the present invention is shown in FIG. 15. Athletic performance evaluating device 500 comprises (1) a first shock sensor unit 115" similar to shock sensor unit 115 of device 300, (2) a control means 60'''' similar to control means 60''' but additionally having a fifth port as described in connection with control means 60 of device 100, (3) a first shock magnitude display unit 80' similar to shock magnitude display unit 80 of device 300, (4) a second shock sensor unit 90 similar to shock sensor unit 115", (5) a second shock magnitude display unit 92 additionally having an elapsed time display and (6) appropriate connecting means. Device 500 utilizes shock magnitude display unit 80' to display the performance response generated by first shock sensor unit 115" while the corresponding elapsed time is displayed on the display of control means 60''''. The shock magnitude display unit 92 displays elapsed time and shock magnitude generated by second shock sensor unit 90. Device 500 operates on a single clock which is generated by control means 60'''' as explained in connection with device 100.

Figure 16:
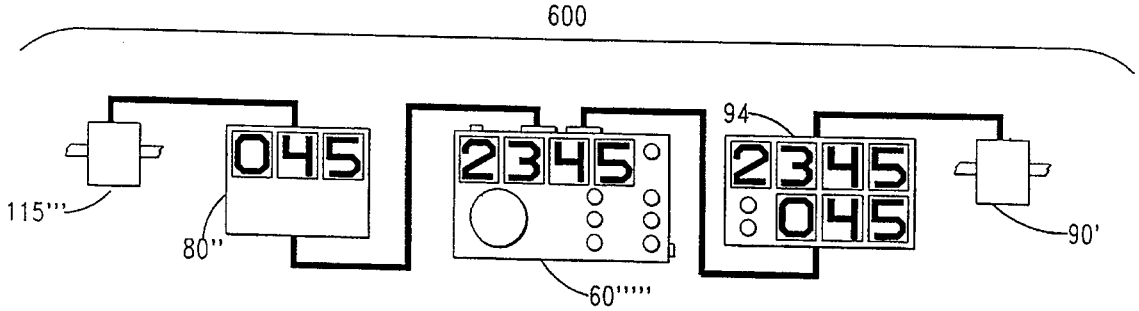
FIG. 16 shows an alternate embodiment of the present invention including a shock magnitude display unit and an averaging unit.

Yet another alternate embodiment of the present invention is shown in FIG. 16. Athletic performance evaluating device 600 comprises (1) a shock sensor unit 115''' similar to shock sensor 115 of device 300, (2) a control means 60''''' similar to control means 60''' but additionally having appropriate ports to connect to external units and modules, (3) a shock magnitude display unit 80" similar to shock magnitude display unit 80, (4) an averaging module 94 and (5) appropriate connecting means. Device 600 performs like Device 500 but with a average module 94 which displays average elapsed time and average force magnitude. Note that in this FIG. 16, unit 94 requires a second shock sensor unit 90'. Device 600 is used by two athletes simultaneously.

Figure 17:
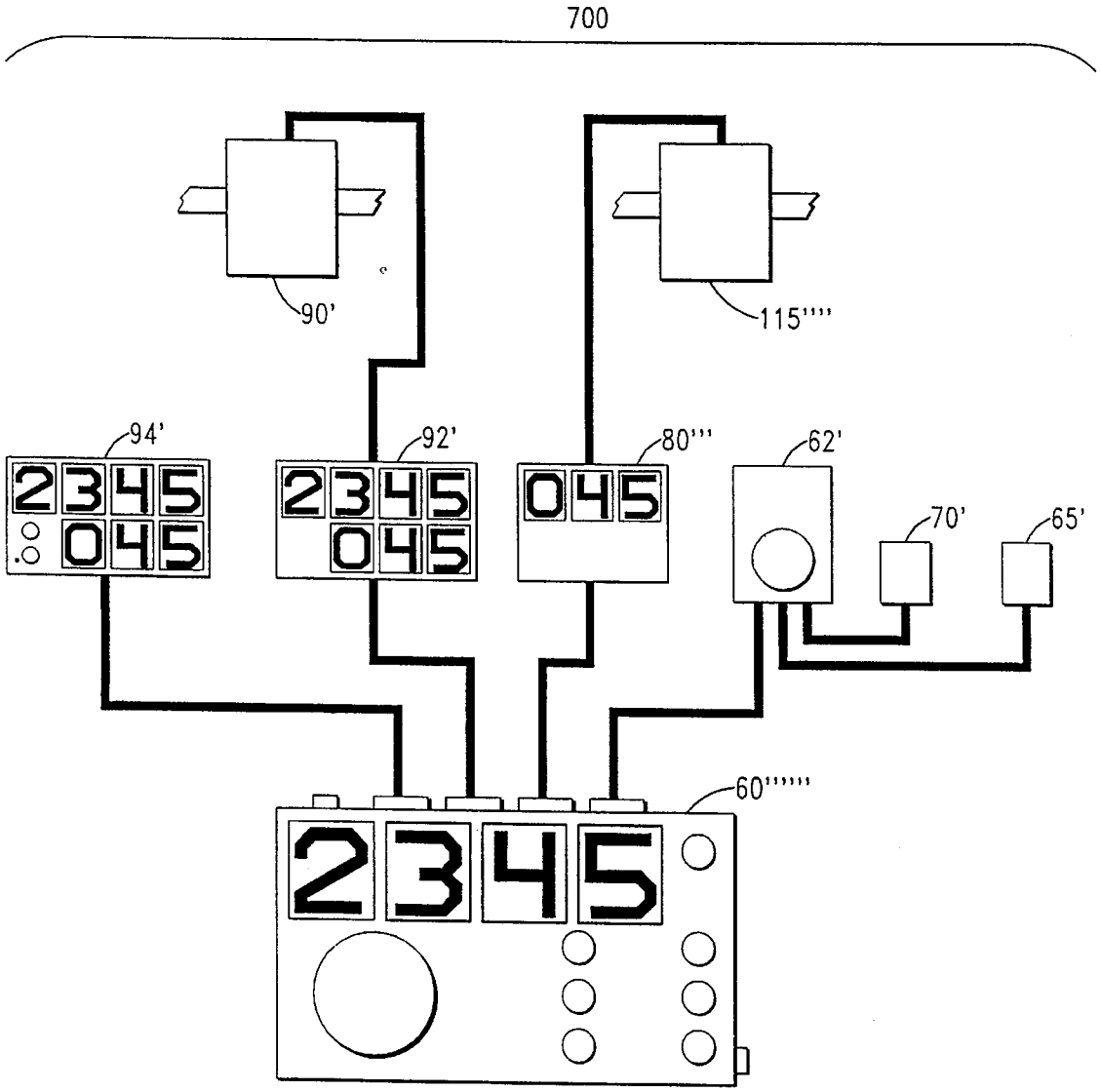
FIG. 17 shows an alternate embodiment of the present invention including a first and second shock sensor unit, a first and second shock magnitude display unit, an averaging unit and a sound module.

In an additional alternate embodiment of the present invention, the various features of the above athletic performance devices can be operably combined. For example, athletic performance evaluating device 700, illustrated in FIG. 17, is an alternate embodiment of the present invention comprising a combination of devices 100, 200, 300, 400, 500 and 600. Athletic performance evaluating device 700 comprises: (1) a first shock sensor unit 115'''', (2) a second shock sensor unit 90', wherein the first and second shock sensor units utilize proportional shock sensors similar to shock sensor 117 of device 300, (3) a first shock magnitude display unit 80''', (4) a second shock magnitude display unit 92' additionally having an elapsed time display, (5) a control means 60'''', (6) an averaging module 94', (7) a sound module 62', (8) a tone generator 65', (9) a microphone 70', (10) appropriate connecting means and appropriate control means ports. Device 700 can be used by three athletes simultaneously. Control unit 60'''' and first shock magnitude display unit 80''', display the performance obtained from shock sensor unit 115''''. Similarly, second shock magnitude display unit 92' with its elapsed time display displays performance obtained from shock sensor unit 90'. The averaging unit 94' displays the performance obtained from a third shock sensor 90'' (not shown in FIG. 17).

Another example of the present invention is athletic performance evaluating device 750 (not shown) which is a combination of device 500 and one or more additional sensor units and one or more additional display units. These combinations can be obtained by conventional techniques known to those skilled in the art, for example by contacting two or more modules, such as averaging modules, in parallel to the appropriate port of the control means.

Figure 18:
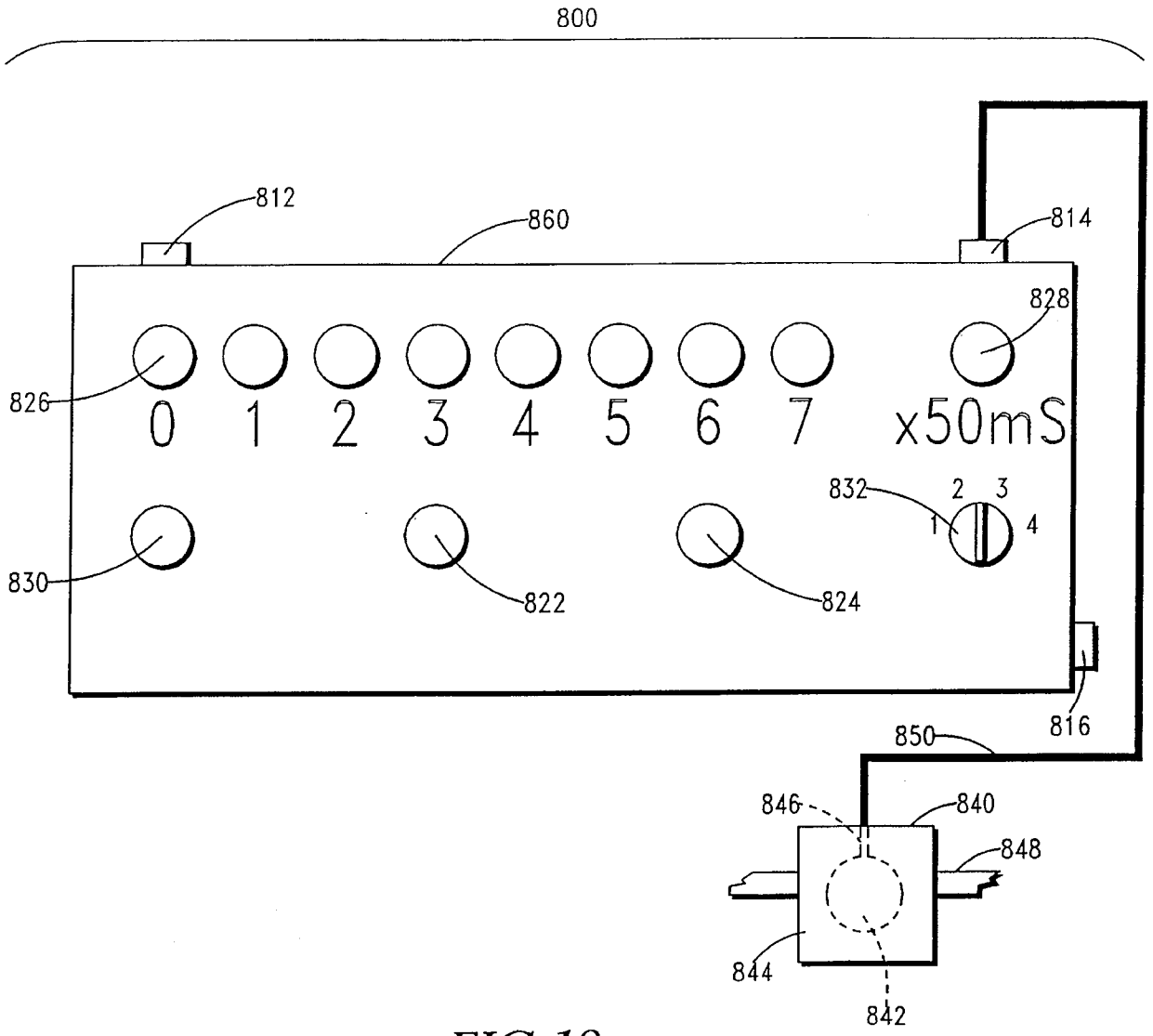
FIG. 18 is a plan view of the top surface of a shock sensor unit an a control means of an alternate embodiment of the present invention.

FIG. 18 illustrates an alternate embodiment of the present invention. Athletic performance evaluating device 800 provides the basic features of the present invention as follows. Athletic performance evaluating device 800 comprises a shock sensor unit 840 and a control means 860, wherein the shock sensor unit and the control means are operatively connected by a communicating means 850. Shock sensor unit 840 comprises a shock sensor 842 similar to shock sensor 42 described in connection with athletic performance evaluating device 100. Shock sensor 842 is enclosed in a housing 844 wherein electrical connections 846 provide the operable connection between the shock sensor 842 and the communicating means 850. Optionally, the sensor housing can be equipped with a sensor fastening means 848 to fasten sensor unit 840 to a person or object, as described in connection with device 100.

Control means 860 is provided with ports 812, 814 and 816. Port 812 is for an external speaker for emitting a ready state signal, the speaker or alternately a buzzer must be DC voltage activated. Port 814 connects communicating means 850 to control means 860. Port 816 is utilized for an external DC power supply for control means 60. Alternately, the DC power supply can be built into control means 860. On/Off switch 822 connects the power supply to control means 860 when switch 822 is in the on position, similar to the power supply of device 100 shown in FIG. 2A.

Figure 8:
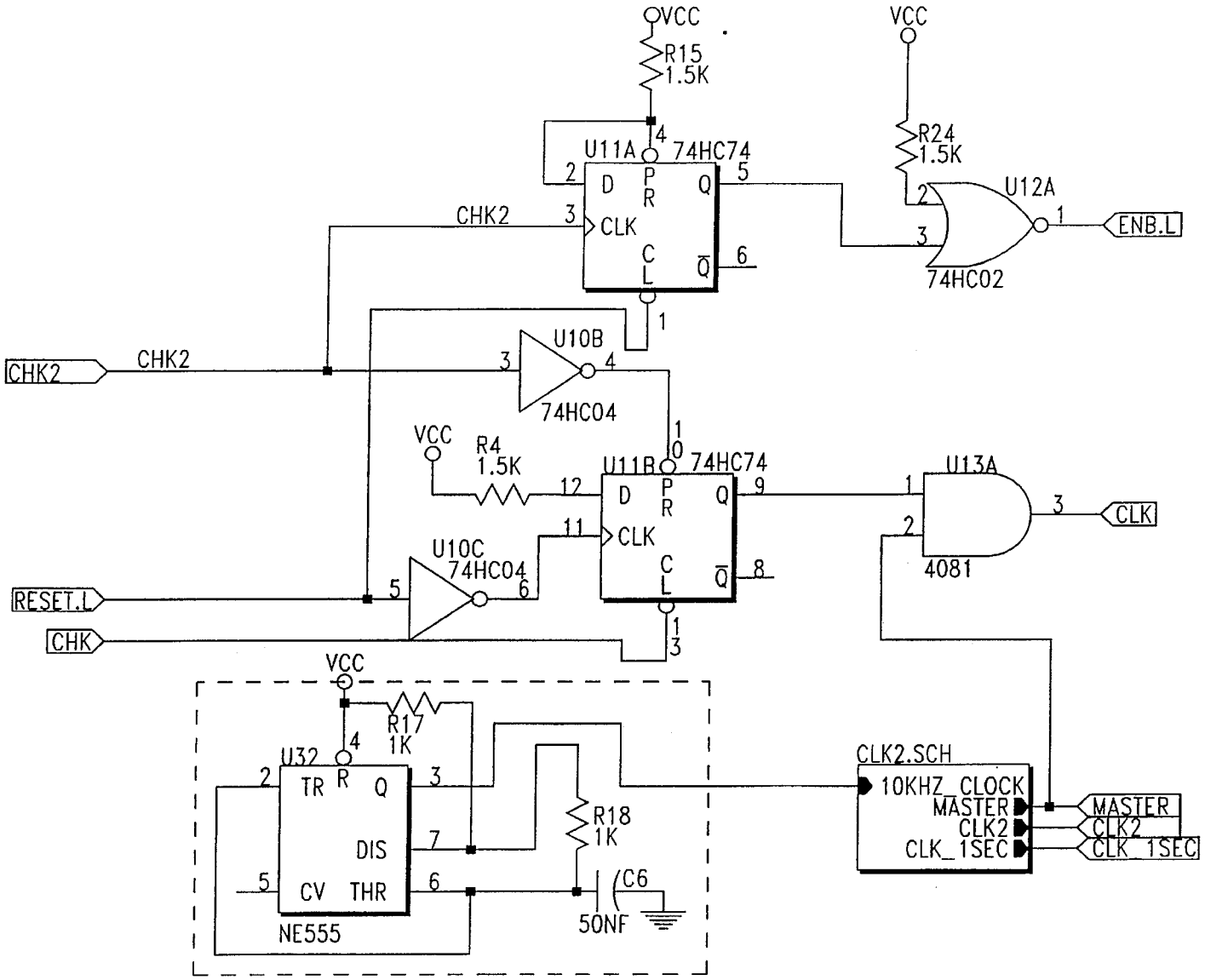
FIG. 8 is a schematic circuit diagram of a clock of FIG. 2A.
Figure 9:
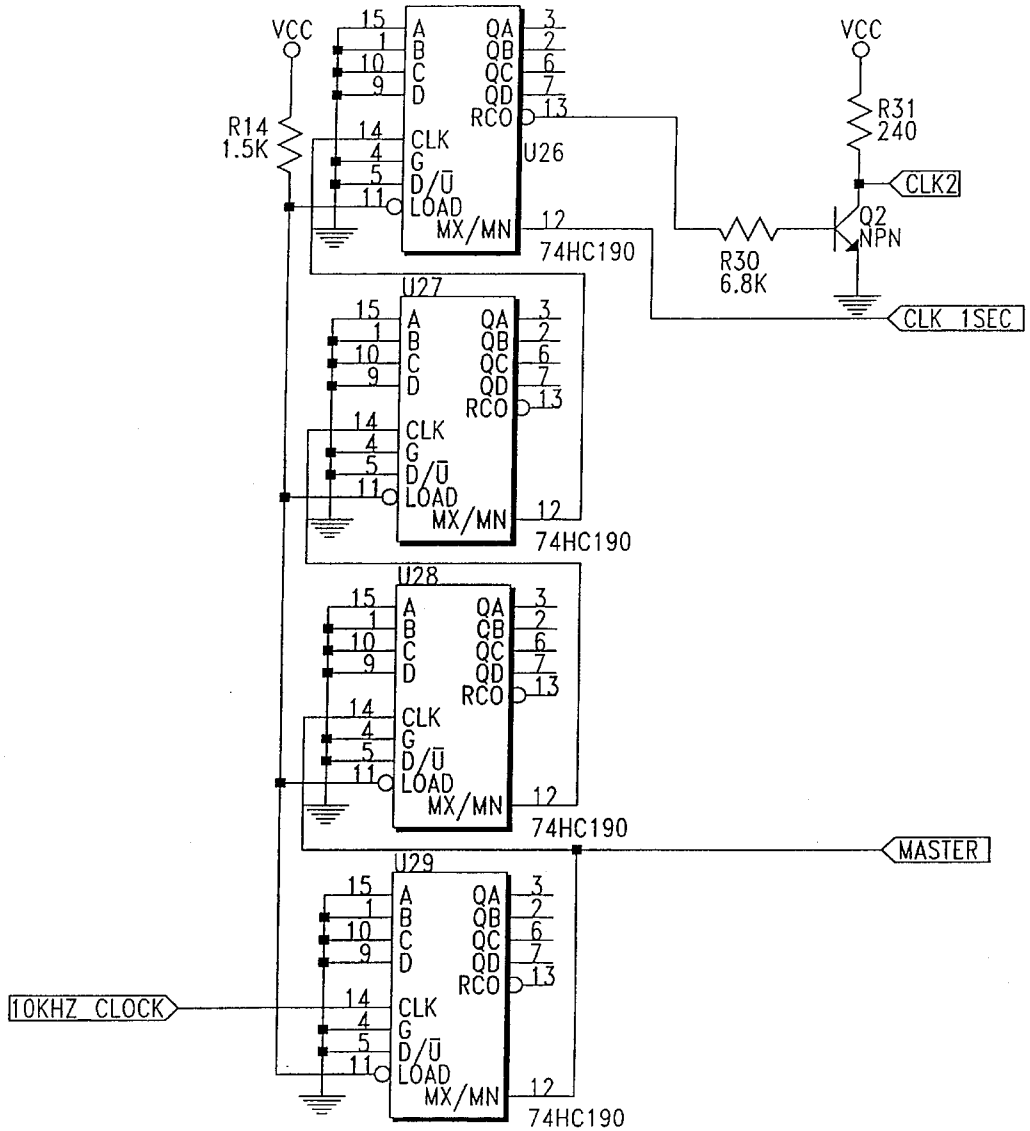
FIG. 9 is a schematic circuit diagram of the clock block diagram of FIG. 8.
Figure 19:
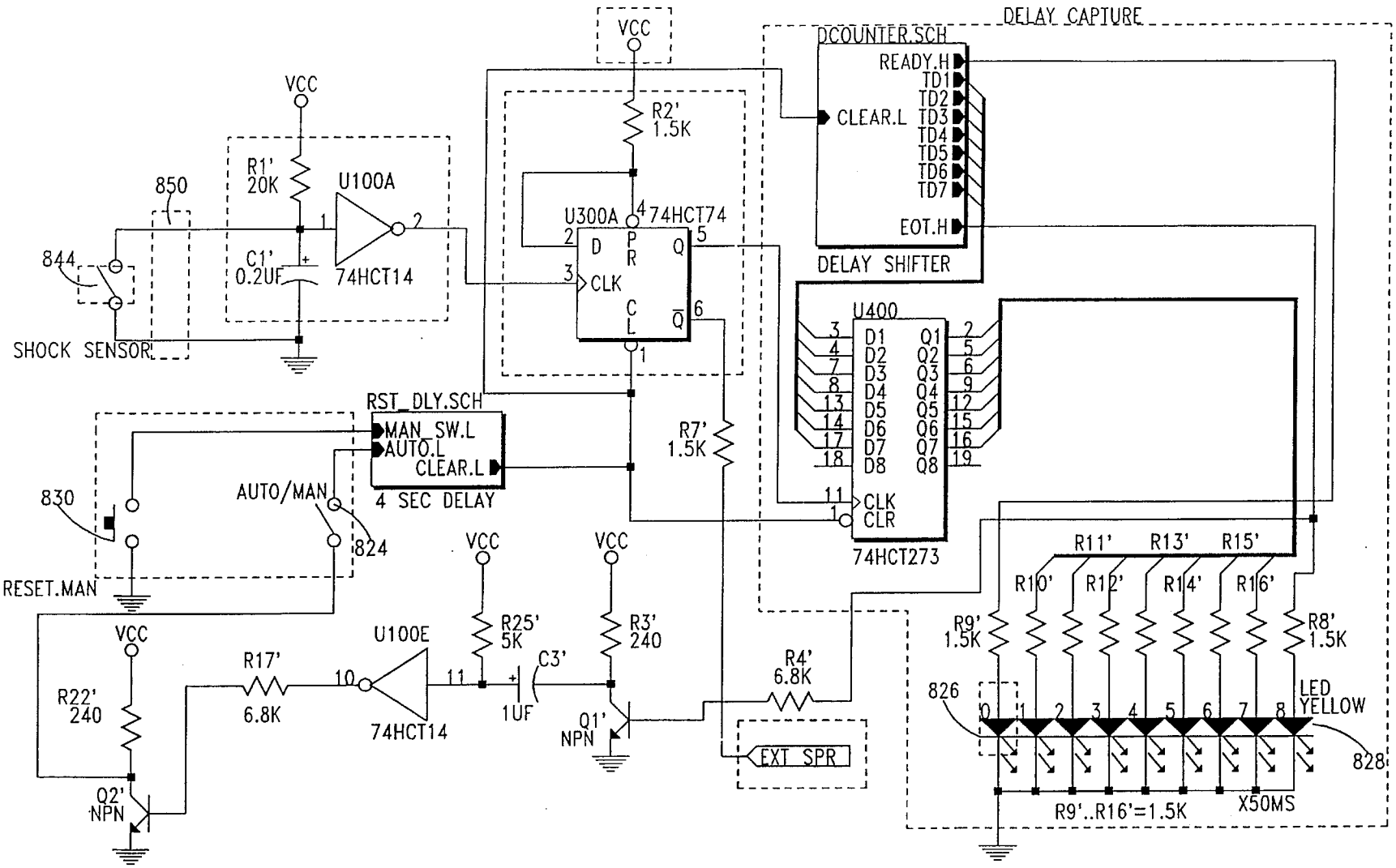
FIG. 19 shows a block diagram and a schematic circuit diagram illustrating one embodiment of the shock sensor unit and the control means of the device of FIG. 18.

An Auto/Man automatic or manual reset selection switch 824 (FIG. 19) is the ready state generator of device 800, providing a similar function as switch 124 of device 100. An LED display unit 826 (FIGS. 18 and 19) provides display LED indicators 0 through 7 wherein LED indicators 0 through 7 each represent about 50 milliseconds (ms) delay based on the clocking speed of the input clock signal in FIG. 20, based on the resistors and capacitors values used in combination with the 555 timer circuit, similar to the corresponding circuit diagram of FIG. 8. Numbered lights 1 through 7 provide the performance reporting means of device 800. Stop LED 828 (FIGS. 18 and 19) indicates the end of a cycle when lit. Reset switch 830 resets the LEDs of display unit 826 as shown in FIG. 19. Reset Delay 832 resets the time delay, this represents the rotary 4-to-1 analog MUX switch of FIG. 21.

Device 800 functions as follows. When On/Off switch 822 is in the on position and Auto/Man switch 824 is in the man position, the delay state generator rst_dly.sch block diagram in FIG. 19 will generate a time delay (shown in FIG. 21) which is a shift register in which a data of logic one is clocked at a 1 second interval. The logic 1 is serially shifted into the SR input pin of the shift register, U6-21, per 1 second clock pulse. Positioning the RESET DELAY switch to its first position causes a delay of 1 second, position 2 causes a delay of 2 seconds, and so forth. The maximum delay is 4 seconds. After the signal propagates through the circuit shown in FIG. 21, it will then propagate and enable the circuits in FIG. 20. The propagated signal from FIG. 21 loads ZEROs into the output of the SHIFT REGISTERS U2-20 and U5-20 in FIG. 20, which are buffered by octal D-FF buffer 74HCT373 in FIG. 19. The LED 1 through 7 are connected to the outputs of 74HCT373 and display the status of the SHIFT-REGISTERS. The octal D-FF is used to capture the status of the shift registers output when a shock is detected. A 50 ms clock period is used to shift a logic ONE into the SHIFT-REGISTERS.

When a shock is generated by the athlete which is sufficient to close the normally open contacts of shock sensor 842 of device 800, the closure of these contacts generates an electrical effect which is transmitted via communicating means 850 (FIGS. 18 and 19) to the control means 860 through the input inverter U100A shown in FIG. 19. This electrical effect is then further processed by the electrical effect processing means D-FF 74HCT74, which then generates a signal to latch the status of the LEDs 826 (FIGS. 18 and 19). When the propagating signal reaches the last inverter the Stop LED 828 is lit, indicating the end of the performance evaluating cycle. The beginning of the ready state (i.e. the end of the delay period) of is shown when LED No. 0 of LED display 826 is lit.

LEDs 1 through 7 of Display 826 of device 800 comprise the athletic performance reporting means which is used to determine the athlete's reaction time since each of these LEDs represents a 50 ms reaction time. For example, if at the end of the evaluating cycle (i.e. when Stop LED 828 is lit) LEDs Nos 1 through 4 are lit, it means an athlete reaction time of at least 200 ms and less than 250 ms. In the above example, each of the LEDs 1 through 7 represents a 50 ms time interval, but other time interval values can be pre-set in control means 800 by choosing different values for resistors and capacitors in combination with the 555 timer circuit, similar to the circuit diagram shown in FIG. 8.

Figure 20:
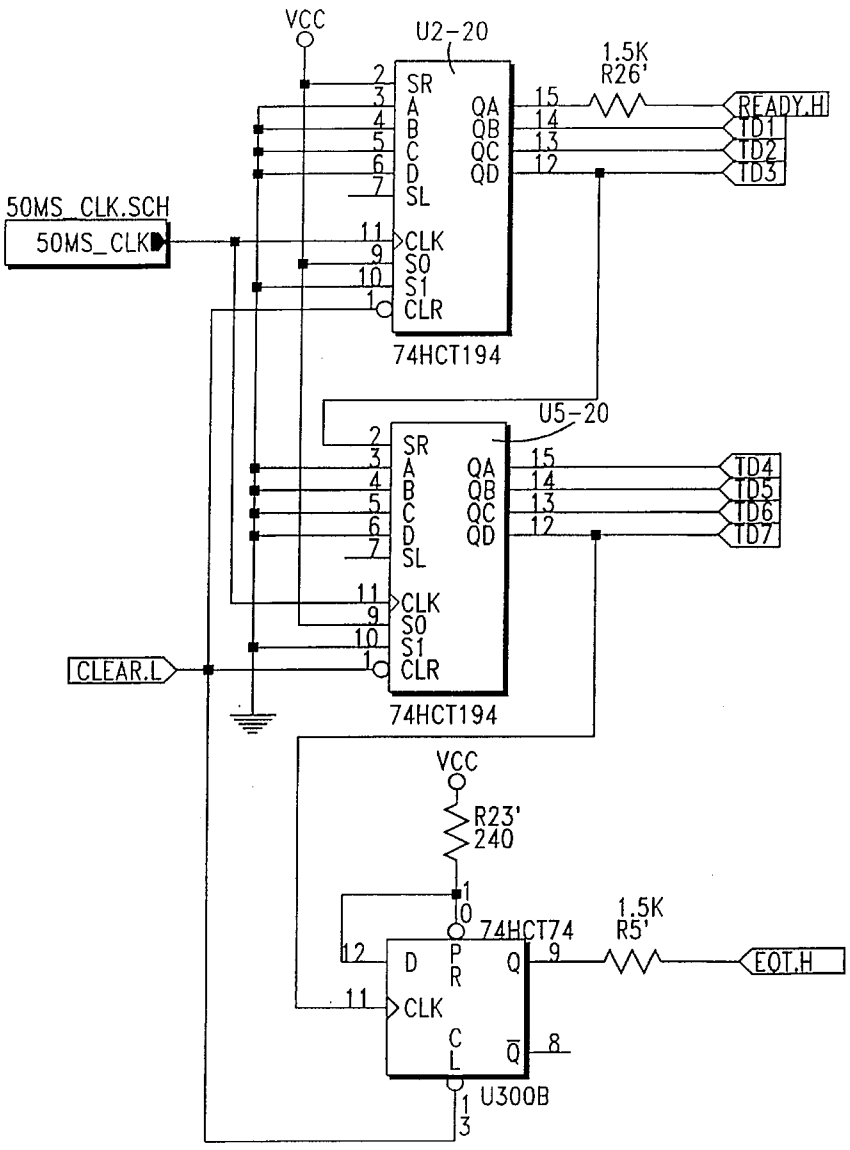
FIG. 20 is a schematic circuit diagram of LED drivers clocked at 50 ms.

The conventional circuits illustrated in FIG. 20 function as follows. After CLEAR.L signal makes a RTO signal, the outputs of shift registers U2-20 and U5-20 are cleared and set to logic zeroes. After the CLEAR. L signal returns to a logic one state, a logic one is shifted into the output and each following clock pulse of the 50 ms input clock will shift a logic one into the shift registers U2-20 and U5-20 serially, leaving the outputs a trail of logic one. The first shift is the ready state indicator and this is displayed by first LED 0. The EOT.H signal turns on the last LED 8 display which indicates the end of the ready state. The source of the 50 ms clock pulses is constructed using a 555 timer, similar to the circuit of FIG. 8. When the READY state indicator is lit, it signals the user to act. The shock magnitude produced by the user will cause the D-FF to capture the status of the shift register outputs td1 through td7. To read the response time, the number of LEDs (1 through 7) that are lit are counted and multiplied by the clock pulse, in this case 50 ms.

Figure 21:
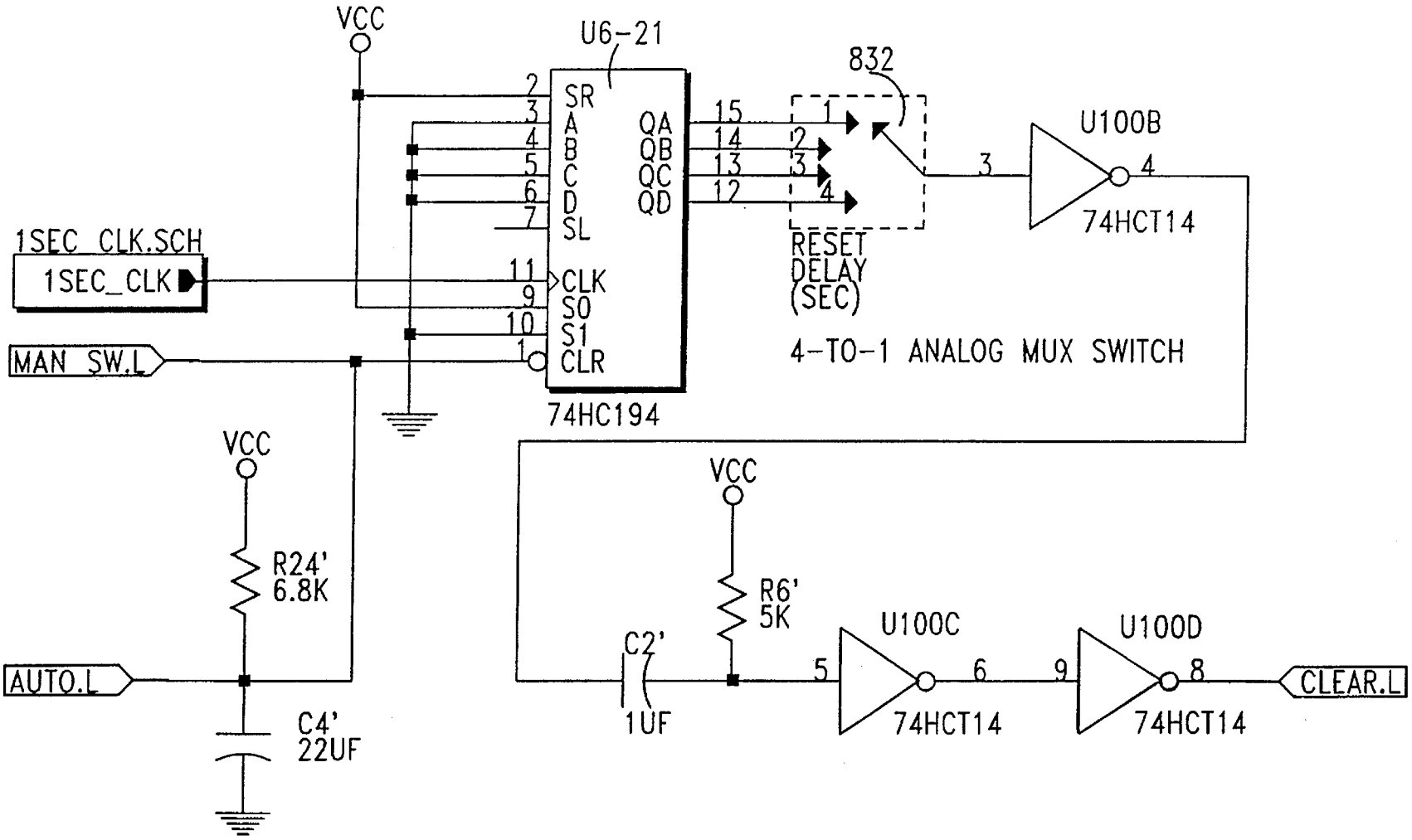
FIG. 21 is a schematic circuit diagram of reset delay clocked at 1 second.

The circuits illustrated in FIG. 21 function as follows. The CLEAR.L signal is generated from the circuits shown in FIG. 21. The CLEAR.L signal sets the outputs of all the shift registers, U2-20, U5-20 (FIG. 20), U6-21 (FIG. 21), and D-FF to logic zero, thus generating the ready state of device 800. When the AUTO/MAN switch is in the AUTO position, the position of the RESET DELAY switch determines the signal delay of CLEAR.L. When the AUTO/MAN switch is in the MAN position, the momentary switch button is required to initiate the ready state of device 800. Shift register U6-21 shifts a logic one every 1 second clock pulse and depending on the position of the switch, the reset delay can be from 1 to 4 seconds. The source of the 1 second clock pulse is constructed using a 555 timer, similar to the circuit of FIG. 8.

Athletic performance evaluating device 800 has been illustrated above using a normally open shock sensor. However, an alternate embodiment (not shown) is equally operable wherein a normally closed shock sensor is used. In order to use a normally closed shock sensor the circuit of FIG. 19 is modified in a manner similar to FIG. 2C. The communicating means between shock sensor 842 and control means 860 is depicted in FIG. 18 as a hard wire connection. Alternately, a wireless electrical connection can be used as described in connection with device 100.

The athletic evaluating results of the above devices such as shock magnitude, elapsed time, average shock magnitude and average elapsed time can be downloaded into a computer, such as, for example, a personal computer through a suitable buffer means. The computer can then be utilized to display or print the results.

Figure 22:
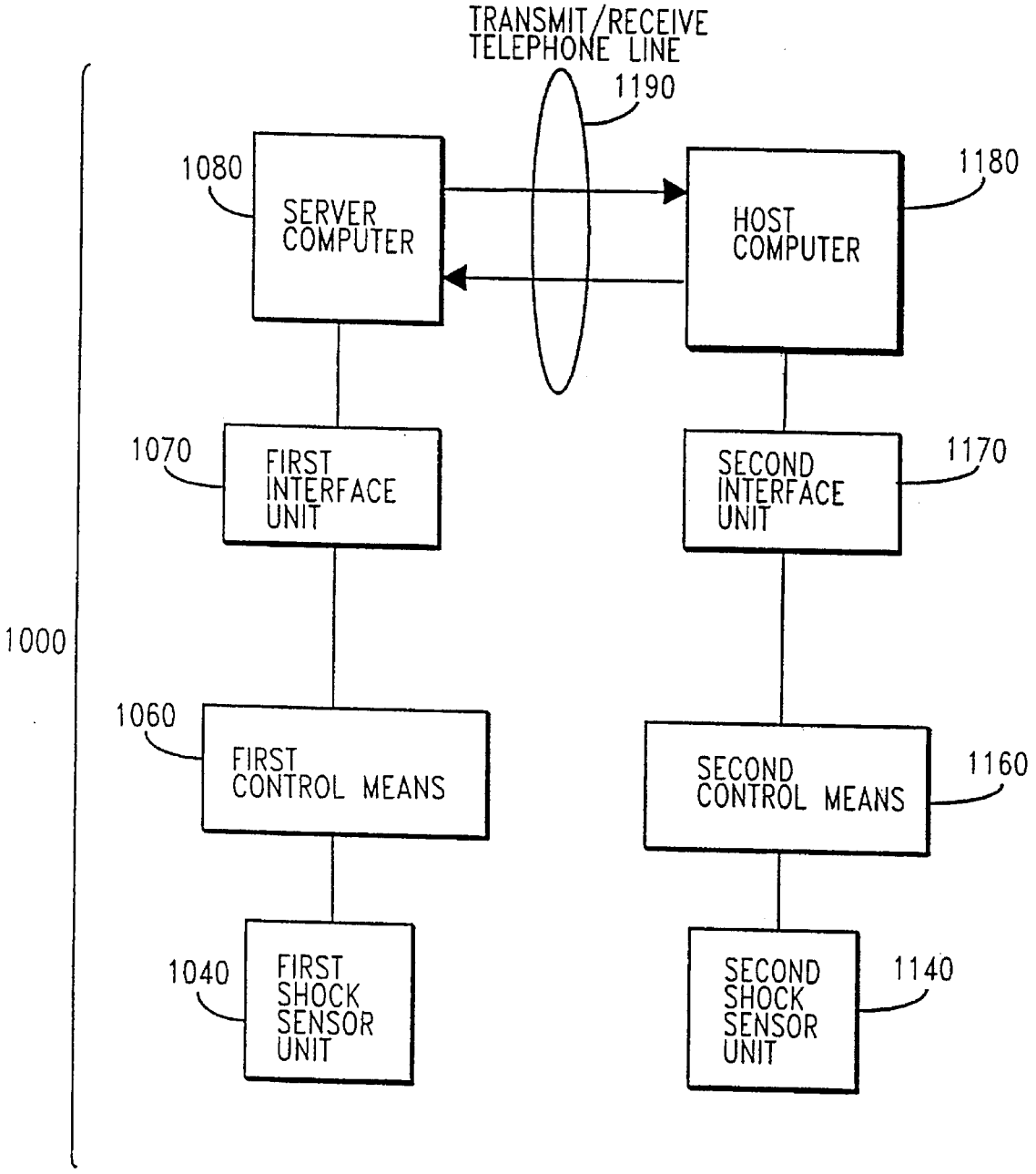
FIG. 22 shows an alternate embodiment of the present invention including a first and second shock sensor unit, a first and second control means, a first and second computer and a telecommunicating means.
Figure 23:
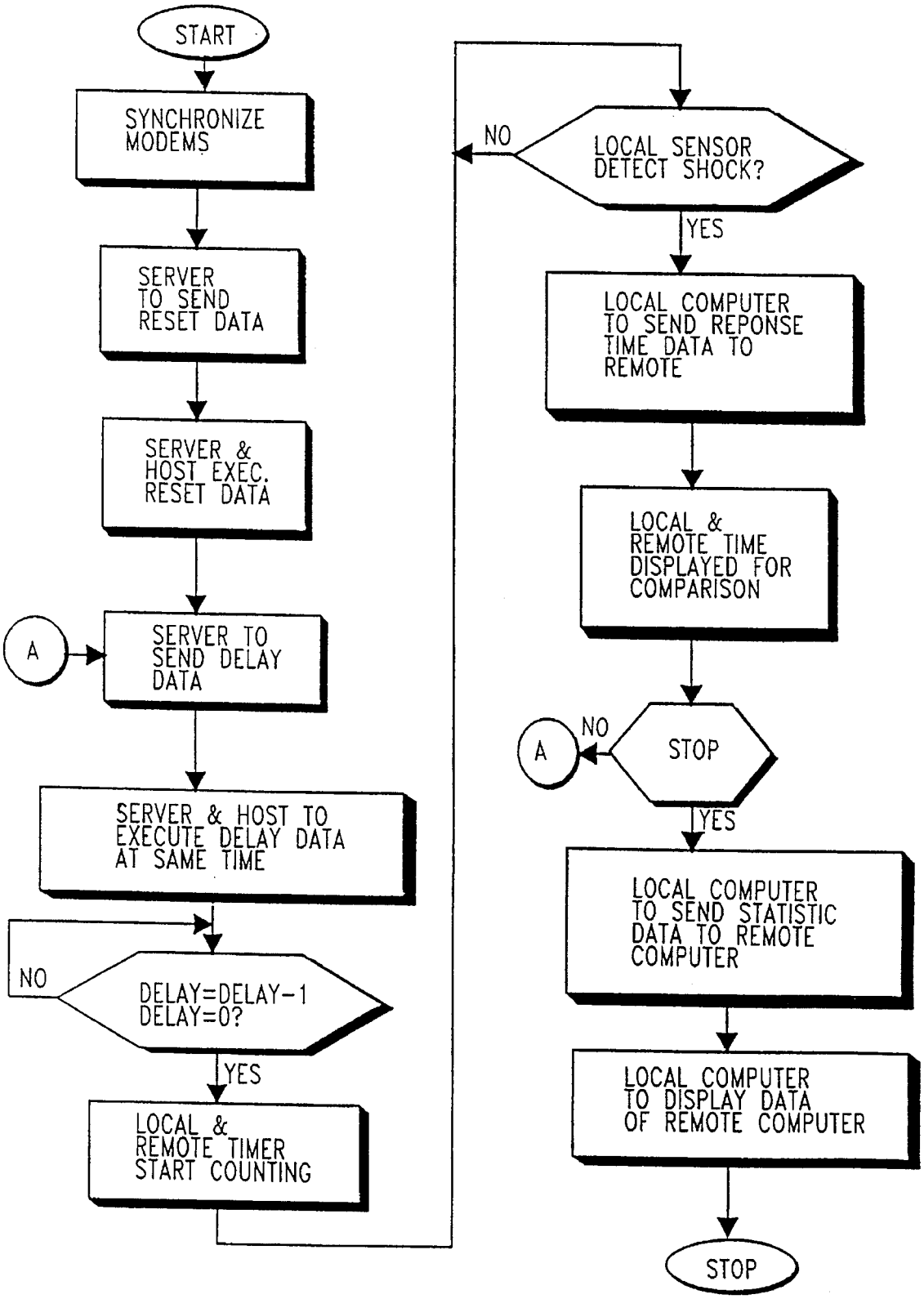
FIG. 23 is a flowchart illustrating the functioning of the device of FIG. 22.

A further alternate embodiment of the present invention is depicted in FIG. 22. Athletic performance evaluating device 1000 comprises (1) a first shock sensor unit 1040, (2) a first control means 1060, (3) a first interface unit 1070, (4) server computer 1080 having a first modem, (5) a second shock sensor unit 1140, (6) a second control means 1160, (7) a second interface unit 1170, (8) a host computer 1180 having a second modem, (9) a telecommunications link 1190 for linking the first modem to the second modem and (10) appropriate connecting means. This device enables two users of the present invention to compete with each other while they are in different locations. The flowchart shown in FIG. 23 illustrates the operation of device 1000. Interface unit 1070 contains a buffer where elapsed time and shock magnitude are stored per event. The interface unit 1070 also has circuitry that allows a computer to read and process the elapsed time and shock magnitude. To control the interface unit, a computer program is utilized to enable the computer and the interface unit to communicate with each other. The functions of first interface unit 1070 are substantially identical with the functions of second interface unit 1170.

To operate the device, one remote computer has to be on-line, connected to a telephone line and on a host mode. The local computer or server must connect to the remote computer via modem. First, both modems must have the same communication setup to be synchronized with each other. Second, the server computer must send reset data to the remote computer. The reset data will clear the buffers in the interface units. Third, the server computer will send the random delay data to the remote computer to provide a synchronous point of time reference for both computers. For example, if the random delay data is 00000101, and the speed per transmission for both computers is 10 Mhz or 100 ns cycle time, the program will then cause the interface units to process the random delay data after 3 cycles: (expansion of 3 cycles) at the first cycle the local computer sends the random delay data; at the second cycle the remote computer receives the data, at the third cycle both computers should have the delay data and be ready to execute. In the present example, the binary coded decimal 5 is loaded to the random delay counter 150, and since both computers are synchronized they will share the same clock edge. As soon as the programmed delay has elapsed, the display counter for both computers will start counting and the screen will display the elapsed time. Only the local asynchronous sensor generated electrical effects will stop the counters. One cycle after the counter stops, the local computer will send elapsed time and shock magnitude to the remote computer and vise, versa. This would conclude 1 cycle per event.

Figure 24:
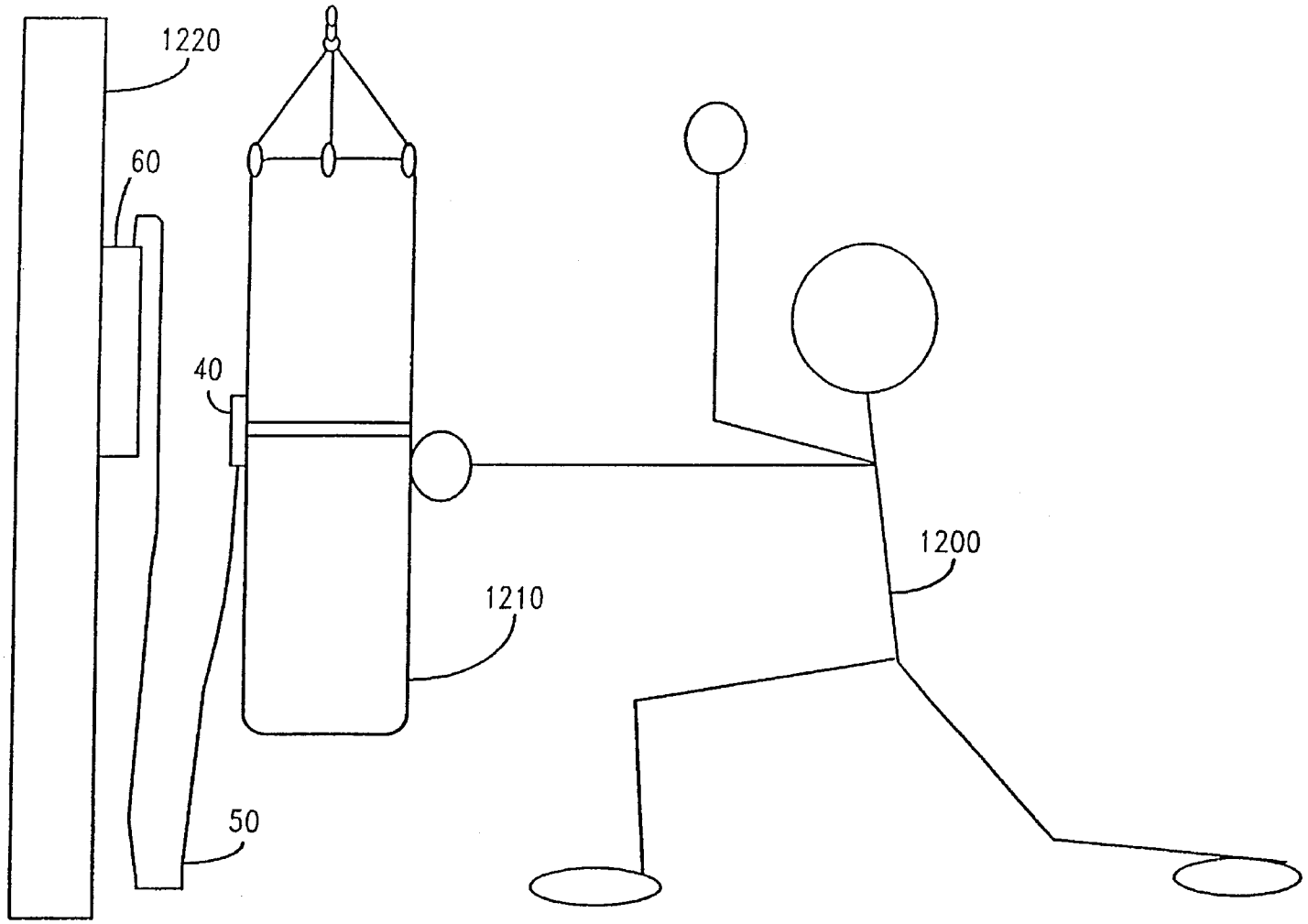
FIG. 24 is a schematic representation of a boxer using a device of the present invention.
Figure 25:
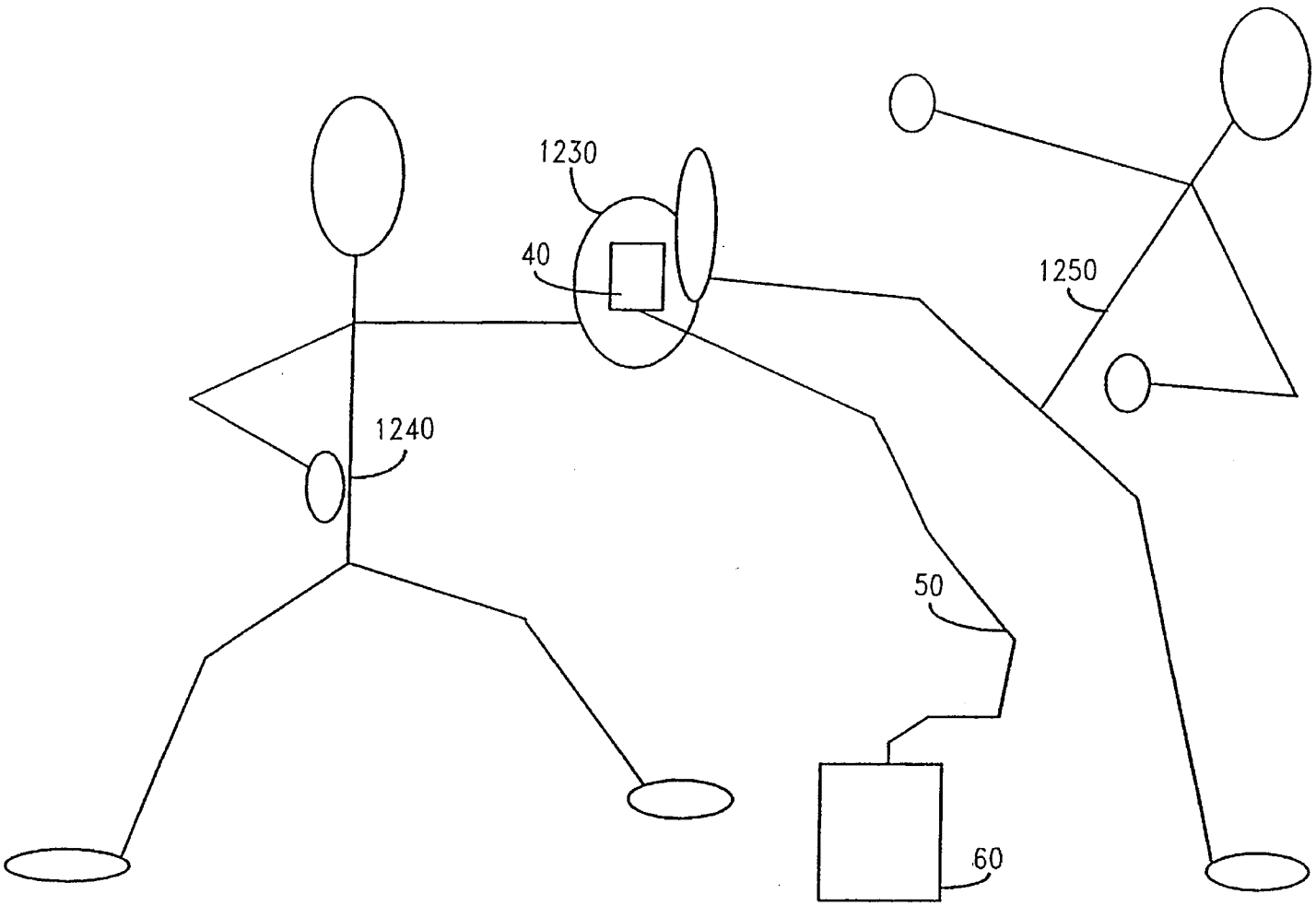
FIG. 25 is a schematic representation of two martial arts athletes using a device of the present invention.
Figure 26:
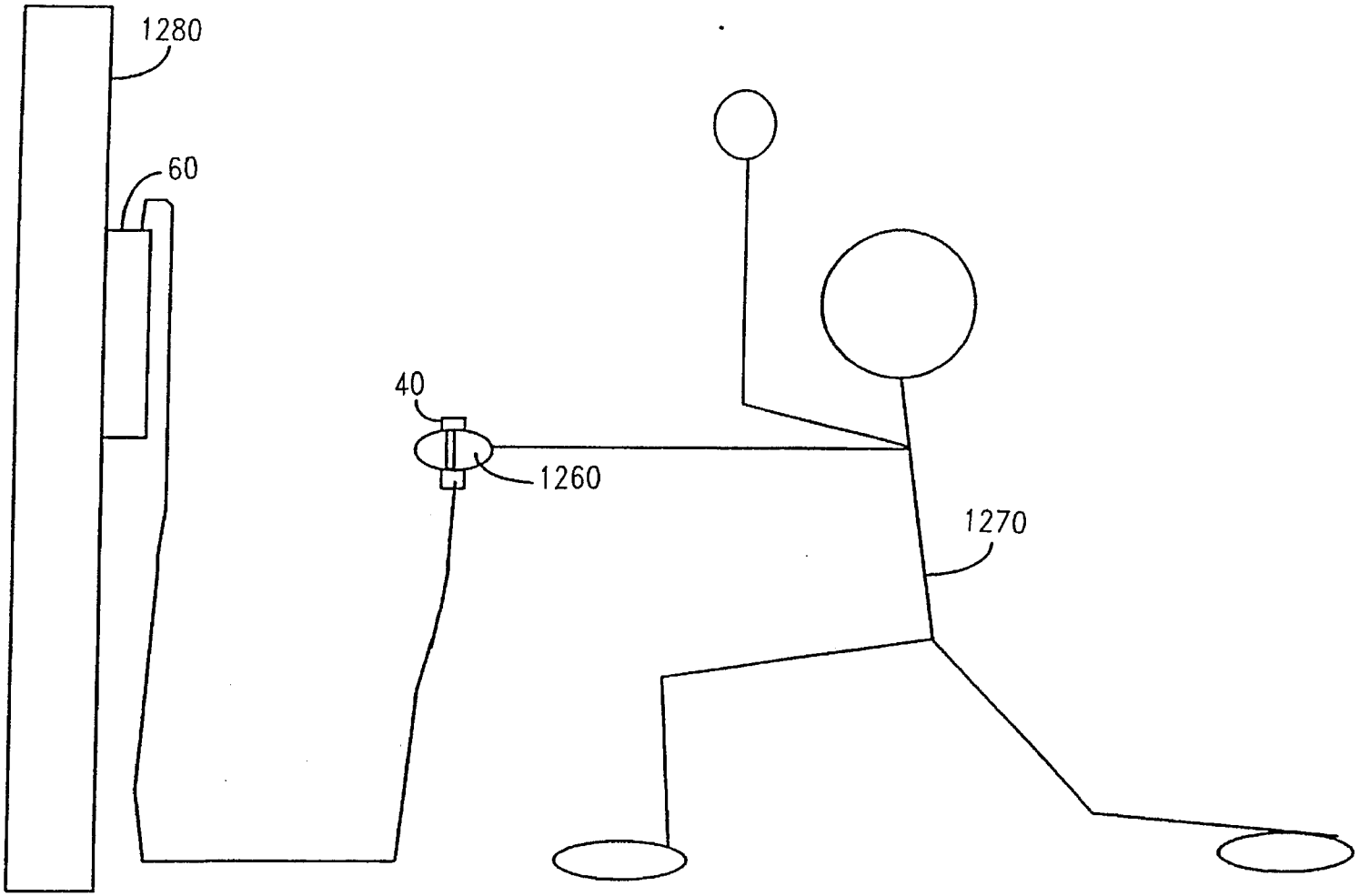
FIG. 26 is a schematic representation of a martial arts athlete using a device of the present invention.

FIGS. 24, 25 and 26 illustrate the use of athletic performance evaluating device 100 in simulated unarmed combat sports. FIG. 24 depicts the use of device 100, described in connection with FIG. 1, to evaluate the performance of a user, such as a boxer 1200, hitting a punching bag 1210. Shock sensor unit 40 is attached to punching bag 1210, while control means 60 is removably attached to a support structure, such as, for example, a wall 1220 using conventional attachment means, such as, for example, a strap (not shown). Alternately, control means 60 can be held by another person, strapped to the boxer, or placed nearby on the floor. Hard wire connection 50 provides the operative communicating means between shock sensor unit 40 and control means 60. A suitable shock sensor 42 having a predetermined sensitivity level is exemplified by a mercury shock sensor such as disclosed in Bitko '162.

The various switches (FIG. 1) of control means 60 are set as follows: (1) on-off switch 112 is in the on position, (2) LED-tone & LED switch 120 in the tone & LED position, and auto-manual switch 124 on auto. When the boxer is in position, reset switch 126 is pushed thus starting a random delay state of 4 to 11 seconds. At the end of the delay state, control means 60 starts the ready state as evidenced by lighting the ready light LED 116 and generating a tone through speaker 118. At the same time the response time display 121 starts counting.

Returning to FIG. 24, boxer 1200 is alerted to the ready state through the ready light and tone at which point in time the boxer immediately attempts to hit punching bag 1210. When the boxer hits the punching bag, shock sensor unit 40 will generate an electrical effect if the magnitude of the shock resulting from the hit equals or exceeds the predetermined sensitivity level of the shock sensor 42. The electrical effect generated by shock sensor unit 40 ends the ready state of control means 60. When the ready state is ended, stop light 122 is on, ready light 116 is on, tone generation has ceased and response time display 12 1 has stopped counting. The boxer's performance can then be evaluated as follows. The response time display 121 (FIG. 1) shows the boxer's reaction time. The magnitude of the impact of hitting the punching bag can be deduced from the predetermined sensitivity level of shock sensor 42. Alternately, boxer 1200 can use shock sensors having different sensitivity levels, using control means 60 in the manual mode. This enables the boxer to more precisely quantify the shock impact. As a result the boxer can use athletic performance evaluating device 100 to improve both the reaction speed and the magnitude of the hit.

FIG. 25 illustrates the use of device 100 for martial arts performance evaluation. Sensor unit 40 is attached to a pad 1230, also known as a focus pad, which is held by a person 1240. Control means 60 is held by person 1240 or placed nearby, having a hard wire connection 50 between shock sensor unit 40 and control means 60. A user, such as martial arts athlete 1250, then attempts to kick or strike pad 1230. The reaction time and shock magnitude of the athlete's kick is then determined in a manner similar to the description provided in connection with FIG. 24.

FIG. 26 illustrates the use of device 100 for martial arts performance evaluation, wherein the athlete makes a striking or hitting movement without contacting a target or another person, for example, when the user executes a karate form movement. Sensor unit 40 is strapped to a first hand 1260 of a martial arts athlete 1270. Control means 60 is attached to a solid support such as a wall 1280. Alternately, control means 60 can be placed nearby, held by another person or strapped to athlete 1270. When control means 60 is in the ready state, as described in connection with FIG. 24, the athlete immediately attempts to make a striking movement. For this athletic performance evaluation the predetermined sensitivity level of shock sensor 42 is such that the acceleration of the hand as it moves to the imaginary target does not trigger a response by the shock sensor while the hit, as determined by an abrupt stop of the first hand, has sufficient shock magnitude to equal or exceed the sensitivity level of the shock sensor. The performance of the martial arts athlete can then be determined in a similar manner as described in connection with FIG. 24.

EXAMPLES

Performance evaluating device 100 (FIG. 1) was used in Examples 1 through 3, utilizing a shock sensor with a movable mass of mercury similar to the shock sensor disclosed in Bitko '164. The shock sensor having a sensitivity level of 12G was sealed in a housing and hard wired to control means 60 (FIG. 1). Thus, a shock impact of 12G or greater magnitude will stop the ready state of control means 60. A shock impact which is less than 12G will not generate any response by control means 60.

The various switches (FIG. 1) of control means 60 are set as follows: (1) on-off switch 112 is in the on position, (2) LED-tone & LED switch 120 in the tone & LED position, and auto-manual switch 124 on auto. When the athlete is in position, reset switch 126 is pushed thus starting a random delay state of 4 to 11 seconds. At the end of the delay state, control means 60 starts the ready state as evidenced by lighting the ready light LED 116 and generating a tone through speaker 118. At the same time the response time display 121 starts counting.

Example 1

Karate Performance Evaluation

This example illustrates the utility of the present invention for evaluating karate performance wherein striking or kicking movements are executed without contacting a target. Device 100 is utilized as illustrated in FIG. 26. In this example, the shock sensor was attached to the users right hand. A right reverse punch was executed wherein a punching movement is made with the right hand while rotating the hip. The right hand is returned to the starting position upon completion of the punch. Karate trainee A conducted 20 trials on day 1 and on day 2. The results are reported as reaction time in milliseconds (ms) which is the response time between beginning and ending the ready state.

TABLE 4

| | Reaction Time (ms) | | |
|---|---|---|---|
| Day | Average | Lowest | Highest |
| Day 1 | 448 | 377 | 647 |
| Day 2 | 408 | 241 | 577 |

It is well known to those practicing the sport of karate that reaction speed is one of the most important performance criteria. The results in Table 1 show that the averaged reaction times are sufficiently reproducible to form a useful basis for a karate performance evaluation of hitting an imaginary target.

Example 2

Karate Performance Evaluation

This example illustrates the utility of the present invention for evaluating karate performance when using a target. The shock sensor is mounted on a target focus pad for hitting with a right hand reverse punch, as illustrated in FIG. 25. The target is placed at arm's length from the user to simulate a typical fighting distance between two fighters. The performance is measured as a reaction time, as described in Example 1, and as an average speed which is computed as the athlete's arm length divided by the average reaction time. Some of the karate trainees who participated in Example 2 have ranked performance levels ranging for their overall karate performance from 1 (beginner) through 7 (advanced). Each reaction time reported in the following Table 2 is an average of ten trials.

TABLE 5

| Trainee | Rank | Reaction Time ms | Arm Length meter | Speed meter/sec |
|---|---|---|---|---|
| B | 7 | 406 | 0.72 | 1.77 |
| C | 4 | 421 | 0.72 | 1.71 |
| D | | 471 | 0.77 | 1.63 |
| E | 6 | 441 | 0.70 | 1.59 |
| F | 5 | 514 | 0.74 | 1.44 |
| G | 2 | 536 | 0.72 | 1.34 |
| H | | 487 | 0.62 | 1.33 |
| I | | 594 | 0.74 | 1.25 |
| J | | 625 | 0.67 | 1.07 |
| K | | 634 | 0.65 | 1.03 |
| L | 5 | 752 | 0.70 | 0.93 |
| M | 1 | 657 | 0.60 | 0.91 |
| N | 1 | 617 | 0.43 | 0.70 |

Example 2 demonstrates that the device is suitable for measuring individual performance levels for each of the trainees. It is interesting to note that trainee L demonstrated a relatively slow speed while L is ranked at level 5. This indicates that L may need to improve his right hand reverse punch in order to improve his overall ranking in karate.

Example 3

Tennis Performance Evaluation

In this example, device 100 was used to evaluate one performance aspect of tennis, i.e. hitting the ball with a predetermined speed. The sensor unit 40 was fastened to the player's right wrist. The player then served the ball by tossing it into the air and hitting the ball with a tennis racket held in the right hand.

Using the 12G shock sensor it was found that a hit which resulted in a ball distance of 10.86 meter or more was sufficient to generate the stop signal of control means 60. Hits resulting in a ball distance of 9.47 meter or less failed to generate a stop signal. Ball distances between 9.47 and 10.86 meters provided inconclusive results. Example 3 illustrates that the invention is suitable for training a tennis player in obtaining predictability and accuracy in serving the ball.

The above examples are provided merely as illustrations of the utility of the present invention and are not intended to limit the invention as claimed herein.

Alternately the sensor unit can be attached to a sport device such as a baseball bat, tennis racket or a hockey stick for an athletic performance evaluation. In yet another alternate utility of the present invention a sensor of a first device 100 can be attached to a sports device such as a baseball bat while the sensor of a second device 100 is attached to the player's wrist. The athlete can then determine if the kinetic energy is efficiently transmitted from the athlete's body to the sports device through a determination of any significant shock impact differences between the bat-mounted first device 100 and the athlete-mounted second device 100.

The above illustrations of the various embodiments show that the present invention can be used to evaluate athletic performance in such sports as, for example: baseball, boxing, escrima (a martial arts sport using a stick as a weapon), fencing, football, golf, hockey, lacrosse, karate, martial arts, racket ball, soccer, softball, tennis and volleyball. The novel devices of the present invention enable the athlete to evaluate athletic performance in a realistic manner wherein the device itself does not significantly affect the particular athlete activity. The current invention can be used for evaluating the performance of a single athlete or of several athletes simultaneously.

The shock sensor unit of the novel devices of the present invention can be attached to the athlete, a target or a sport device, such as a baseball bat, golf club, hockey stick, tennis racket, racket ball racket, fencing foil or lacrosse stick. The shock sensor can be attached to a user at the user's hand, wrist, arm, shoulder, foot, ankle, leg, hip or head. For example, when practicing football, the player can hit a tackle dummy in which case the shock sensor can be fastened to the player's hip or shoulder if this is the player's intended contact point with the tackle dummy. In soccer, it is common to practice to head the ball. A shock sensor of the present invention can be fastened to a soccer player's head, for example by using a fastening means such as a head band. The device then aids the soccer player in evaluating different heading techniques in order to improve the heading performance. The current invention is fully operable in martial arts sports without hitting a target, when the shock sensor is fastened to the user.

The invention has been described in terms of the preferred embodiments. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims.

We claim:

1. An athletic performance evaluating device comprising:

a) a first shock sensor having a predetermined sensitivity, wherein the first shock sensor comprises a transducer responding to a shock induced movement of an inertial mass, in which the shock induced movement is caused by a first shock magnitude, whereby the shock induced movement generates a first electrical effect;

b) a first control means for detecting, controlling and reporting the first shock sensor first electrical effect, wherein the first control means comprises: (1) a delay state generator for selectively generating a delay time, (2) a ready state generator wherein a ready state is generated upon completion of the delay time, during which ready state the first control means is enabled to detect the first electrical effect, (3) an electrical effect processing means for processing the first electrical effect when the first control means is in the ready state, wherein the electrical effect processing means provides a first athletic performance result, (4) a performance reporting means for reporting the first athletic performance result, (5) a power supply to provide electrical power to the first control means and (6) a first control means housing, to contain the first control means therein, wherein the first shock sensor is external to the first control means housing; and c) a communicating means for operatively connecting the first shock sensor to the first control means.

2. The device according to claim 1 additionally comprising a first shock sensor housing for enclosing the first shock sensor therewithin, wherein the housing provides for operatively connecting the first shock sensor to the communicating means.

3. The device according to claim 2 additionally comprising a first shock sensor fastening means for selectively fastening the first shock sensor housing to a first member.

4. The device according to claim 3 wherein the first shock sensor is adapted for responding to a first shock magnitude which is caused by a sudden deceleration of a movement of the first member when the first sensor is attached to the first member, such that the deceleration is caused by halting the movement without causing the first member to contact an object.

5. The device according to claim 3 wherein the first shock sensor fastening means is selected from the group consisting of stretchable belts and stretchable straps.

6. The device according to claim 3 wherein the first member is selected from the group consisting of persons and objects.

7. The device according to claim 3 wherein the inertial mass is a mass selected from the group consisting of electrically conductive liquids, magnets, electrically conductive ball shaped articles, flexible beams and pendulums.

8. The device according to claim 3 wherein the first electrical effect is selected from the group consisting of closing a normally open switch, opening a normally closed switch, generating a DC voltage and generating a DC voltage which is proportional to the shock magnitude.

9. The device according to claim 3 wherein the electrical effect is selected from the group consisting of closing a normally open switch and opening a normally closed switch.

10. The device according to claim 3 wherein the delay state generator selectively generates a delay time ranging from 4 seconds to 11 seconds, in which the delay time is randomly selected through the use of a random number generator in conjunction with a counter following a pre-set delay time of 4 seconds.

11. The device according to claim 3 wherein the ready state generator additionally comprises a ready state indicator, in which the ready state indicator is activated upon completion of the delay time.

12. The device according to claim 11 wherein the ready state indicator is selected from the group of indicators consisting of visual indicators, audio indicators and audio-visual indicators.

13. The device according to claim 11 wherein the ready state indicator comprises a first light.

14. The device according to claim 11 wherein the ready state generator additionally comprises a ready state end point indicator, in which the ready state end point indicator is activated upon generation of the first shock sensor first electrical effect.

15. The device according to claim 14 wherein the ready state end point indicator is selected from the group of indicators consisting of visual indicators, audio indicators and audio-visual indicators.

16. The device according to claim 14 wherein the ready state end point indicator comprises a second light.

17. The device according to claim 14 wherein the first performance result comprises a first response time, in which the first response time is measured as the elapsed time between activation of the ready state indicator and activation of the ready state end point indicator.

18. The device according to claim 17 whereto the performance reporting means comprises a visual display showing the first response time.

19. The device according to claim 18 wherein the display is selected form the group of displays consisting of LED numbers, LCD numbers and numbered lights.

20. The device according to claim 3 wherein the communicating means is selected from the group consisting of hard wire electrical connections and wireless electrical connections.

21. The device according to claim 3 additionally comprising a sound module having a tone generator and microphone for audio reporting of the ready state indicator and the first response time.

22. The device according to claim 3 wherein the first electrical effect comprises a first DC voltage which is proportional to the first shock magnitude.

23. The device according to claim 22 additionally comprising a first shock magnitude display unit for displaying a first shock magnitude performance result of the first shock sensor, wherein the first shock magnitude display unit is interposed between the first shock sensor and the first control means.

24. The device according to claim 23 additionally comprising:

a) a second shock sensor for generating a second electrical effect comprising generating a second DC voltage which is proportional to a second shock magnitude, wherein the second shock sensor has a housing and a second fastening means for fastening the second shock sensor housing to a second member;

b) a second shock magnitude display unit for displaying a second shock magnitude performance result of the second shock sensor, wherein the second shock magnitude display unit is interposed between the second shock sensor and the first control means; and c) a means for enabling the first control means to detect the second electrical effect during the ready state, wherein the first shock sensor and the second shock sensor are used simultaneously for obtaining the first shock magnitude performance result and the second shock magnitude performance result.

25. The device according to claim 23 additionally comprising:

a) a second shock sensor for generating a second electrical effect comprising generating a second DC voltage which is proportional to a second shock magnitude, wherein the second shock sensor has a housing and a second fastening means for fastening the second member; and b) a first averaging module for displaying a first averaged response time performance result and a first averaged shock magnitude performance result, wherein the first averaging module is interposed between the second shock sensor and the first control means; and c) a means for enabling the first control means to detect the second electrical effect during the really state, wherein the first shock sensor and the second shock sensor are used simultaneously for obtaining (1) the first shock magnitude performance result, (2) the first averaged response time performance result and (3) the first averaged shock magnitude performance result.

26. The device according to claim 22 additionally comprising a first averaging module for displaying a first averaged response time performance result and a first averaged shock magnitude performance result, wherein the first averaging module is interposed between the first shock sensor and the first control means.

27. The device according to claim 3 additionally comprising:

a) a server computer having a first modem;

b) a first interface unit for interfacing the server computer with the first control means;

c) a second shock sensor for generating a second electrical effect, wherein the second shock sensor has a housing and a second fastening means for fastening the second shock sensor housing to a second member;

d) a second control means for detecting, controlling and reporting the second sensor second electrical effect;

e) a host computer having a second modem;

f) a second interface unit for interfacing the host computer with the second control means;

g) a telecommunications link for operatively linking the first modem to the second modem; and h) software to provide operative links between the first control means and the second control means, wherein the software comprises means for (1) synchronizing the first modem with the second modem, (2) synchronizing the first control means with the second control means such that the detection of the first electrical effect by the first control means is synchronized with the detection of the second electrical effect by the second control means through a shared clock edge, wherein the first control means is operated simultaneously with the second control means, (3) reporting the first electrical effect to the server computer, (4) reporting the first electrical effect to the host computer, (5) reporting the second electrical effect to the host computer and (6) reporting the second electrical effect to the server computer.

28. The device according to claim 3 wherein the first shock magnitude is generated by an athletic performance in a sport selected from the group of sports consisting of baseball, boxing, escrima, fencing, football, golf, hockey, lacrosse, karate, martial arts, racket ball, soccer, softball, tennis and volleyball.

29. The device according to claim 28 wherein the athletic performance is a predetermined series of karate movements without contacting a target.

30. An athletic performance evaluating device comprising:

a) a first shock sensor unit fastened to a first member, wherein the first shock sensor unit comprises: (1) a first shock sensor having a predetermined first sensitivity, wherein the first shock sensor comprises a transducer responding to a shock induced movement of a first inertial mass, in which the shock induced movement is caused by a first shock magnitude, whereby the shock induced movement generates a first electrical effect, (2) a first shock sensor housing for enclosing the first shock sensor therewithin and (3) a first shock sensor fastening means for selectively fastening the first shock sensor housing to the first member;

b) a first control means for detecting, controlling and reporting the first shock sensor first electrical effect, wherein the first control means comprises: (1) a delay state generator for selectively generating a delay time, (2) a ready state generator wherein a ready state is generated upon completion of the delay time, during which ready state the first control means is enabled to detect the first electrical effect, (3) an electrical effect processing means for processing tee first electrical effect when the first control means is in the ready state, wherein the electrical effect processing means provides a first athletic performance result, (4) a performance reporting means for reporting the first athletic performance result, (5) a power supply to provide electrical power to the first control means and (6) a first control means housing, to contain the first control means therein, wherein the first shock sensor is external to the first control means housing; and c) a communicating means for operatively connecting the first shock sensor to the first control means.

31. The device according to claim 30 wherein the first shock sensor is adapted for responding to a first shock magnitude which is caused by a sudden deceleration of a movement of the first shock sensor such that the deceleration is caused by halting the movement without contacting an object.

32. The device according to claim 30 wherein the first member is selected from the group consisting of persons and objects.

33. The device according to claim 32 wherein the objects are selected from the group of objects consisting of martial arts targets, punching bags, baseball bats, hockey sticks, golf clubs, tennis rackets, racket ball rackets, fencing foils, and lacrosse sticks.

34. The device according to claim 30 additionally comprising:

a) a second shock sensor unit fastened to a second member, wherein the second shock sensor unit comprises: (1) a second shock sensor having a predetermined second sensitivity wherein the second shock sensor comprises a transducer responding to shock induced movement of a second inertial mass, in which the shock induced movement is caused by a second shock magnitude, whereby the shock induced movement generates a second electrical effect, (2) a second shock sensor housing for enclosing a second shock sensor therewithin and (3) a second shock sensor fastening means for selectively fastening the second shock sensor housing to the second member;

b) a shock magnitude display unit for displaying the second shock athletic performance results which are generated by the second shock sensor unit, wherein the shock magnitude display unit is interposed between the second shock sensor and the first control means; and c) a means for enabling the first control means to detect the second electrical effect during the ready state, wherein the first shock sensor and the second shock sensor are used simultaneously for obtaining the first shock magnitude performance result and the second shock magnitude performance result.

35. The device according to claim 34 wherein the second member is selected from the group consisting of persons and objects.

36. The device according to claim 1 wherein the first shock sensor is adapted for responding to a first shock magnitude which is caused by a sudden deceleration of a movement of the first shock sensor such that the deceleration is caused by halting the movement without contacting an object.

37. A method for evaluating athletic performance, wherein the method comprises:

a) selecting a first shock sensor unit, wherein the first shock sensor unit comprises: (1) a first shock sensor having a predetermined first sensitivity, wherein the first shock sensor comprises a transducer responding to a shock induced movement of a first inertial mass, in which the shock induced movement is caused by a first shock magnitude, whereby the shock induced movement generates a first electrical effect, (2) a first shock sensor housing for enclosing the first shock sensor therewithin and (3) a first shock sensor fastening means for selectively fastening the first shock sensor housing to a first member;

b) electrically connecting the first shock sensor to a first control means for detecting, controlling and reporting the first shock sensor first electrical effect, wherein the first control means comprises: (1) a delay state generator for selectively generating a delay time, (2) a ready state generator wherein a ready state is generated upon completion of the delay time, during which ready state the first control means is enabled to detect the first electrical effect, (3) an electrical effect processing means for processing the first electrical effect when the first control means is in the really state, wherein the electrical effect processing means provides a first athletic performance result, (4) a performance reporting means for reporting the first athletic performance result, (5) a power supply to provide electrical power to the first control, means and (6) a first control means housing, to contain the first control means therein, wherein the first shock sensor is external to the first control means housing.

38. The method of claim 37 wherein the first inertial mass is a mass selected from the group consisting of electrically conductive liquids, magnets, electrically conductive ball shaped articles, flexible beams and pendulums.

39. The method of claim 37 wherein the first shock sensor is adapted for responding to a first shock magnitude which is caused by a sudden deceleration of a movement of the first shock sensor such that the deceleration is caused by halting the movement without contacting an object.

40. The method of claim 37 wherein the first shock sensor is adapted for responding to a first shock magnitude which is caused by a sudden deceleration of a movement of the first member, such that the deceleration is caused by halting the movement without causing the first member to contact an object.

41. The method of claim 37 wherein the first electrical effect is selected from the group of consisting of closing a normally open switch, opening a normally closed switch, generating a DC voltage and generating a DC voltage which is proportional to the shock magnitude.

42. The method of claim 37 wherein electrically connecting comprises providing an electrical connection through a communicating means, wherein the communicating means is selected from the group consisting of hard wire electrical connections and wireless electrical connections.

43. The method of claim 37 wherein the first member is selected from the group consisting of persons and objects.

44. The method of claim 43 wherein the objects are selected from the group of objects consisting of martial arts targets, punching bags, baseball bats, golf clubs, hockey sticks, tennis rackets, racket ball rackets, fencing foils, and lacrosse sticks.

45. The method of claim 37 wherein the first member is selected from the group consisting of a hand, a wrist, an arm, a shoulder, a foot, an ankle, a leg, a hip and a head of a first user.

46. The method of claim 45 wherein the athletic performance is executed towards a first target.

47. The method of claim 46 wherein the first user contacts the first target.

48. The method of claim 46 wherein the first user simulates hitting the first target without contacting the first target.

49. The method of claim 45 wherein the athletic performance which is executed comprises a predetermined series of karate movements without hitting a target.

50. The method of claim 37 wherein the athletic performance which is executed is a sport selected from the group of sports consisting of baseball, boxing, escrima, fencing, football, golf, hockey, lacrosse, karate, martial arts, racket ball, soccer, softball, tennis and volleyball.

51. The method of claim 37 additionally comprising:

a) selecting a second shock sensor unit wherein the second shock sensor unit comprises: (1) a second shock sensor having a predetermined second sensitivity, wherein the second shock sensor comprises a transducer responding to a shock induced movement of a second inertial mass, in which the shock induced movement is caused by a second shock magnitude, whereby the shock induced movement generates a second electrical effect, (2) a second shock sensor housing for enclosing the second shock sensor therewithin and (3) a second shock sensor fastening means for selectively fastening the second shock sensor housing to a second member;

b) electrically connecting the second shock sensor to a shock magnitude display unit for displaying the second shock sensor second electrical effect;

c) electrically connecting the shock magnitude display unit to the first control means;

d) fastening the second shock sensor unit to the second member by means of the second shock sensor fastening means;

e) executing a second athletic performance using a second member having the second shock sensor unit fastened thereto, wherein the first athletic performance and the second athletic performance are executed simultaneously;

f) using the first control means for reporting the first shock sensor first electrical effect wherein the first electrical effect comprises a first athletic performance result;

g) using the shock magnitude display unit for displaying the second shock sensor second electrical effect, wherein the second electrical effect comprises a second athletic performance result; and h) evaluating the first athletic performance result and the second athletic performance result.

52. The method of claim 37 additionally comprising:

a) interfacing the first control means with a server computer having a first modem;

b) selecting a second shock sensor unit wherein the second shock sensor unit comprises: (1) a second shock sensor having a predetermined second sensitivity, wherein the second shock sensor comprises a transducer responding to a shock induced movement of a second inertial mass, in which shock induced movement is caused by a second shock magnitude, whereby the shock induced movement generates a second electrical effect, (2) a second shock sensor housing for enclosing the second shock sensor therewithin and (3) a second shock sensor fastening means for selectively fastening the second shock sensor housing to a second member;

c) electrically connecting the second shock sensor to a second control means for detecting, controlling and reporting the second shock sensor second electrical effect;

d) fastening the second shock sensor unit to the second member by means of the second shock sensor fastening means;

e) interfacing the second control means with a host computer having a second modem;

f) operatively linking the first modem to the second modem through a telecommunications link;

g) executing a second athletic performance using the second member having the second shock sensor unit fastened thereto, wherein the first athletic performance and the second athletic performance are executed simultaneously;

h) using a second control means for reporting the second shock sensor second electrical effect wherein the second electrical effect comprises a second athletic performance result; and i) evaluating the first athletic performance result and the second athletic performance result.

* * * * *